US012790158B2

(12) United States Patent
Yamamoto

(10) Patent No.: US 12,790,158 B2
(45) Date of Patent: Nov. 10, 2026

(54) BAG LOADING APPARATUS AND CONTROL METHOD OF BAG LOADING APPARATUS

(71) Applicant: Horizon Inc., Takashima (JP)

(72) Inventor: Hiroki Yamamoto, Shiga (JP)

(73) Assignee: HORIZON INC., Shiga (JP)

( * ) Notice: Subject to any disclaimer, the term of this patent is extended or adjusted under 35 U.S.C. 154(b) by 73 days.

(21) Appl. No.: 18/832,099

(22) PCT Filed: Jan. 16, 2023

(86) PCT No.: PCT/JP2023/000981

§ 371 (c)(1),
(2) Date: Jul. 22, 2024

(87) PCT Pub. No.: WO2023/140218

PCT Pub. Date: Jul. 27, 2023

(65) Prior Publication Data

US 2025/0100834 A1 Mar. 27, 2025

(30) Foreign Application Priority Data

Jan. 24, 2022 (JP) ..... 2022-008657

(51) Int. Cl.

*B65H 31/24* (2006.01)
*B65B 27/08* (2006.01)
*B65H 31/30* (2006.01)

(52) U.S. Cl.

CPC ..... *B65H 31/24* (2013.01); *B65B 27/08* (2013.01); *B65H 31/3009* (2013.01); *B65H 2301/42172* (2013.01); *B65H 2701/191* (2013.01)

(58) Field of Classification Search

CPC ..... B65H 31/3081; B65H 31/32; B65H 31/3009; B65H 31/34; B65H 31/24;
(Continued)

(56) References Cited

U.S. PATENT DOCUMENTS

2003/0196739 A1* 10/2003 Nakaoda ..... B65H 39/06 156/364
2011/0224820 A1* 9/2011 Gammerler ..... B65H 31/32 700/218
2016/0185557 A1* 6/2016 Herrmann ..... B65H 31/3081 270/58.23

FOREIGN PATENT DOCUMENTS

JP 48-12267 B2 4/1973
JP H05-026808 U 4/1993
JP 2001247250 A * 9/2001

OTHER PUBLICATIONS

Translation of JP 2001247250 A (Year: 2001).*
International Search Report and Written Opinion issued Mar. 14, 2023 in PCT/JP2023/000981 (translation of ISR only).

* cited by examiner

*Primary Examiner* — Thomas M Wittenschlaeger
(74) *Attorney, Agent, or Firm* — Panitch Schwarze Belisario & Nadel LLP

(57) ABSTRACT

Provided is a bag loading apparatus including: a first loading unit configured to load bags of a first line; a second loading unit configured to load bags of a second line; a discharge unit; and a control unit, and the control unit controls the first loading unit to drop the plurality of bags of the first line from the first loading unit onto the discharge unit, controls the discharge unit to move the plurality of bags of the first line dropped onto the discharge unit to an area under the plurality of bags of the second line loaded on the second loading unit, and controls the second loading unit to drop the plurality of bags of the second line from the second loading unit-onto the plurality of bags of the first line.

4 Claims, 19 Drawing Sheets

(58) Field of Classification Search
CPC ..... B65H 2301/42112; B65H 2301/42172;
B65H 2701/191; B65B 27/08
See application file for complete search history.

BAG LOADING APPARATUS AND CONTROL METHOD OF BAG LOADING APPARATUS

CROSS-REFERENCE TO RELATED APPLICATIONS

This application is a Section 371 of International Application No PCT/JP2023/000981, filed Jan. 16, 2023, which was published in the Japanese language on Jul. 27, 2023 under International Publication No. WO 2023/140218 A1, which claims priority under 35 U.S.C. § 119(b) to Japanese Application No. 2022-008657 filed Jan. 24, 2022, the disclosures of each of which are incorporated herein by reference.

TECHNICAL FIELD

The present invention relates to a bag loading apparatus and a control method of a bag loading apparatus.

BACKGROUND ART

Apparatuses that stack a plurality of bags supplied from a bag-making machine and use a bundler to bind a bundle consisting of a plurality of bags are conventionally known (for example, see Patent Literature 1). The apparatus disclosed in Patent Literature 1 uses a sucker to suck bags discharged in a plurality of lines to a bag discharging conveyer and carries the sucked bags to a bag accumulating conveyer and uses a bundler to bind the bundle accumulated in an accumulation pocket from the bag accumulating conveyer. The apparatus disclosed in Patent Literature 1 changes the orientation of some of the bags when carrying the bags by the sucker so that the bags having the bottom part thicker than the opening do not collapse when stacked. Thus, a bundle of a plurality of bags accumulated can have an even height over the entire area.

CITATION LIST

Patent Literature

[PTL 1]
Japanese Utility Model Application Laid-Open No. H5-26808

SUMMARY OF INVENTION

Technical Problem

In Patent Literature 1, however, since operation to suck bags one by one by using a sucker and carry every sucked bag from the bag discharging conveyer to the bag accumulating conveyer is required, the time required to stack a plurality of bags will be longer. Further, since it is required to change the orientation of some of the bags when carrying the bags by the sucker, this will require a certain time to change the orientation of bags. As discussed above, in Patent Literature 1, although a bundle of a plurality of bags accumulated can have an even height over the entire area, this will increase the time required to accumulate a plurality of bags to form a bundle is longer, and the productivity will be reduced.

To address such problems described above, an object is to provide a bag loading apparatus and a control method of a bag loading apparatus that can allow a bundle of a plurality of bags stacked on each other to have an even height over the entire area and shorten the time required to stack a plurality of bags to form a bundle.

Solution to Problem

A bag loading apparatus according to one aspect of the present invention includes: a transport unit configured to transport the bags in a transport direction in a plurality of lines; a first loading unit configured to load the bags of a first line transported by the transport unit; a second loading unit configured to load the bags of a second line transported by the transport unit; a discharge unit arranged below the first loading unit and the second loading unit; and a control unit configured to control the bag loading apparatus, and the control unit controls the first loading unit to drop the plurality of bags of the first line from the first loading unit onto the discharge unit, controls the discharge unit to move the plurality of bags of the first line dropped onto the discharge unit to an area under the plurality of bags of the second line loaded on the second loading unit, and controls the second loading unit to drop the plurality of bags of the second line from the second loading unit onto the plurality of bags of the first line.

According to the bag loading apparatus of one aspect of the present invention, the bags of the first line transported by the transport unit and loaded on the first loading unit are dropped from the first loading unit onto the discharge unit. The plurality of bags of the first line dropped onto the discharge unit are moved to the area under a plurality of bags of the second line loaded on the second loading unit. The plurality of bags of the second line loaded on the second loading unit are dropped onto the plurality of bags of the first line, and a bundle in which the plurality of bags of the second line are stacked on the plurality of bags of the first line is formed.

According to the bag loading apparatus of one aspect of the present invention, when the thickness on one side in the width direction of the bags of the first line is larger than the thickness of the other side in the width direction thereof and the thickness on one side in the width direction of the bags of the second line is smaller than the thickness of the other side in the width direction, the overall thickness of the plurality of bags of the first line is larger on one side than on the other side in the width direction, and the overall thickness of the plurality of bags of the second line is smaller on one side than on the other side in the width direction. Further, in the bundle in which all the plurality of bags of the second line are stacked on all the plurality of bags of the first line, the difference between the thickness on one side in the width direction and the thickness on the other side in the width direction is made even.

As discussed above, according to the bag loading apparatus of one aspect of the present invention, even when the thickness on one side in the width direction of the bags of the first line is larger than the thickness of the other side in the width direction and the thickness on one side in the width direction of the bags of the second line is smaller than the thickness of the other side in the width direction thereof, the bundle of a plurality of bags stacked on each other can have an even height over the entire area. Further, since operation to change the orientation of the bags one by one is not required, the time required to stack the plurality of bags to form the bundle can be shortened.

The bag loading apparatus according to one aspect of the present invention may be configured such that the bag loading apparatus includes a third loading unit arranged above the first loading unit and the second loading unit and configured to load the bags in a plurality of lines transported by the transport unit, and the control unit performs control to switch a mode between a first loading mode and a second loading mode, the first loading mode being to load the bags transported by the transport unit on the first loading unit and the second loading unit, and the second loading mode being to load the bags transported by the transport unit on the third loading unit, and in the second loading mode, controls the first loading unit to drop the plurality of bags of the first line from the first loading unit onto the discharge unit, controls the second loading unit to drop the plurality of bags of the second line from the second loading unit onto the discharge unit, and controls the third loading unit to drop the plurality of bags loaded on the third loading unit onto the first loading unit and the second loading unit.

According to the bag loading apparatus of the present configuration, in the second loading mode to load the bags transported by the transport unit on the third loading unit, a plurality of bags of the first line are dropped from the first loading unit onto the discharge unit, and a plurality of bags of the second line are dropped from the second loading unit onto the discharge unit. Thus, when performing the operation to drop the bags from the first loading unit and the second loading unit onto the discharge unit, it is possible to load the bags transported from the transport unit on the third loading unit without suspending the transport operation on the bags performed by the transport unit.

Further, according to the bag loading apparatus of the present configuration, in the second loading mode, a plurality of bags loaded on the third loading unit are dropped onto the first loading unit and the second loading unit. Thus, the bags transported from the transport unit to the third loading unit can be guided to the first loading unit and the second loading unit during the operation to drop the bags from the first loading unit and the second loading unit onto the discharge unit.

The bag loading apparatus according to one aspect of the present invention may be configured such that the bag loading apparatus includes a bundling unit configured to bind a bundle with a banding band, the plurality of bags of the second line being stacked on the plurality of bags of the first line in the bundle, and the control unit controls the discharge unit to discharge the bundle to the bundling unit.

According to the bag loading apparatus of the present configuration, a bundle in which the difference between the thickness on one side in the width direction and the thickness on the other side in the width direction is made even in the discharge unit can be discharged from the discharge unit to the bundling unit and bound by the banding band.

In a control method of a bag loading apparatus according to one aspect of the present invention, the bag loading apparatus includes a transport unit configured to transport the bags in a transport direction in a plurality of lines, a first loading unit configured to load the bags of a first line transported by the transport unit, a second loading unit configured to load the bags of a second line transported by the transport unit, and a discharge unit arranged below the first loading unit and the second loading unit, and the control method includes: a transport step of controlling the transport unit to load the plurality of bags of the first line on the first loading unit and load the plurality of bags of the second line on the second loading unit; a first drop step of controlling the first loading unit to drop the plurality of bags of the first line from the first loading unit onto the discharge unit; a motion step of controlling the discharge unit to move the plurality of bags of the first line dropped onto the discharge unit to an area under the plurality of bags of the second line loaded on the second loading unit; and a second drop step of controlling the second loading unit to drop the plurality of bags of the second line from the second loading unit onto the plurality of bags of the first line.

According to the control method of the bag loading apparatus of one aspect of the present invention, the bags of the first line transported by the transport unit and loaded on the first loading unit are dropped from the first loading unit onto the discharge unit. The plurality of bags of the first line dropped onto the discharge unit are moved to the area under a plurality of bags of the second line loaded on the second loading unit. The plurality of bags of the second line loaded on the second loading unit are dropped onto the plurality of bags of the first line, and the bundle in which the plurality of bags of the second line are stacked on the plurality of bags of the first line are stacked is formed.

According to the control method of the bag loading apparatus of one aspect of the present invention, when the thickness on one side in the width direction of the bags of the first line is larger than the thickness of the other side in the width direction thereof and the thickness on one side in the width direction of the bags of the second line is smaller than the thickness of the other side in the width direction thereof, the overall thickness of the plurality of bags of the first line is larger on one side than on the other side in the width direction, and the overall thickness of the plurality of bags of the second line is smaller on one side than on the other side in the width direction. Further, in the bundle in which all the plurality of bags of the second line are stacked on all the plurality of bags of the first line, the difference between the thickness on one side in the width direction and the thickness on the other side in the width direction is made even.

As discussed above, according to the control method of the bag loading apparatus of one aspect of the present invention, even when the thickness on one side in the width direction of the bags of the first line is larger than the thickness of the other side in the width direction thereof and the thickness on one side in the width direction of the bags of the second line is smaller than the thickness of the other side in the width direction thereof, the bundle of a plurality of bags stacked on each other can have an even height over the entire area. Further, since operation to change the orientation of the bags one by one is not required, the time required to stack the plurality of bags to form the bundle can be shortened.

The control method of the bag loading apparatus according to one aspect of the present invention may be configured such that the bag loading apparatus includes a third loading unit arranged above the first loading unit and the second loading unit and configured to load the bags in a plurality of lines transported by the transport unit, the control method includes: a switching step (S103) of switching a first loading mode to a second loading mode, the first loading mode being to load the bags transported by the transport unit on the first loading unit and the second loading unit, and the second loading mode being to load the bags transported by the transport unit on the third loading unit; and a third drop step (S107) of controlling the third loading unit to drop the plurality of bags loaded on the third loading unit onto the first loading unit and the second loading unit, and the first drop step, the second drop step, and the third drop step are performed in the second loading mode.

According to the control method of the bag loading apparatus of the present configuration, in the second loading mode to load the bags transported by the transport unit on the third loading unit, a plurality of bags of the first line are dropped from the first loading unit onto the discharge unit, and a plurality of bags of the second line are dropped from the second loading unit onto the discharge unit. Thus, when performing the operation to drop the bags from the first loading unit and the second loading unit onto the discharge unit, it is possible to load the bags transported from the transport unit on the third loading unit without suspending the transport operation on the bags performed by the transport unit.

Further, according to the control method of the bag loading apparatus of the present configuration, in the second loading mode, a plurality of bags loaded on the third loading unit are dropped onto the first loading unit and the second loading unit. Thus, the bags transported from the transport unit to the third loading unit can be guided to the first loading unit and the second loading unit during the operation to drop the bags from the first loading unit and the second loading unit onto the discharge unit.

The control method of the bag loading apparatus according to one aspect of the present invention may be configured such that the bag loading apparatus includes a bundling unit configured to bind a bundle with a banding band, the plurality of bags of the second line being stacked on the plurality of bags of the first line in the bundle, and the control method includes a discharge step of controlling the discharge unit to discharge the bundle to the bundling unit.

According to the control method of the bag loading apparatus of the present configuration, a bundle in which the difference between the thickness on one side in the width direction and the thickness on the other side in the width direction is made even in the discharge unit can be discharged from the discharge unit to the bundling unit and bound with the banding band.

Advantageous Effects of Invention

According to the present invention, it is possible to provide a bag loading apparatus and a control method of a bag loading apparatus that can allow a bundle of a plurality of bags stacked on each other to have an even height over the entire area and shorten time required to stack a plurality of bags to form a bundle.

DESCRIPTION OF EMBODIMENTS

Figure 1:
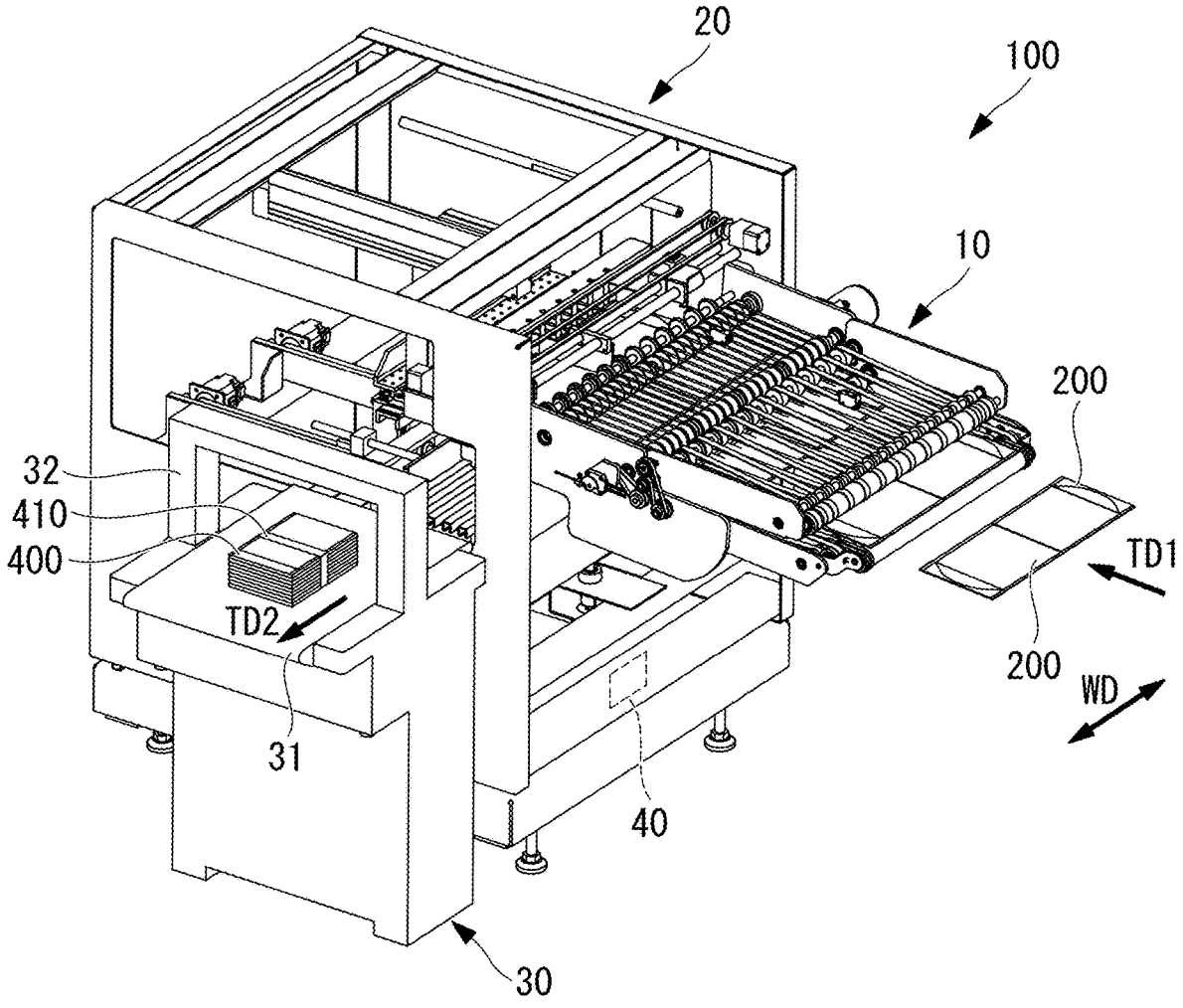
FIG. 1 is a perspective view illustrating a bag loading apparatus according to one embodiment of the present invention.
Figure 2:
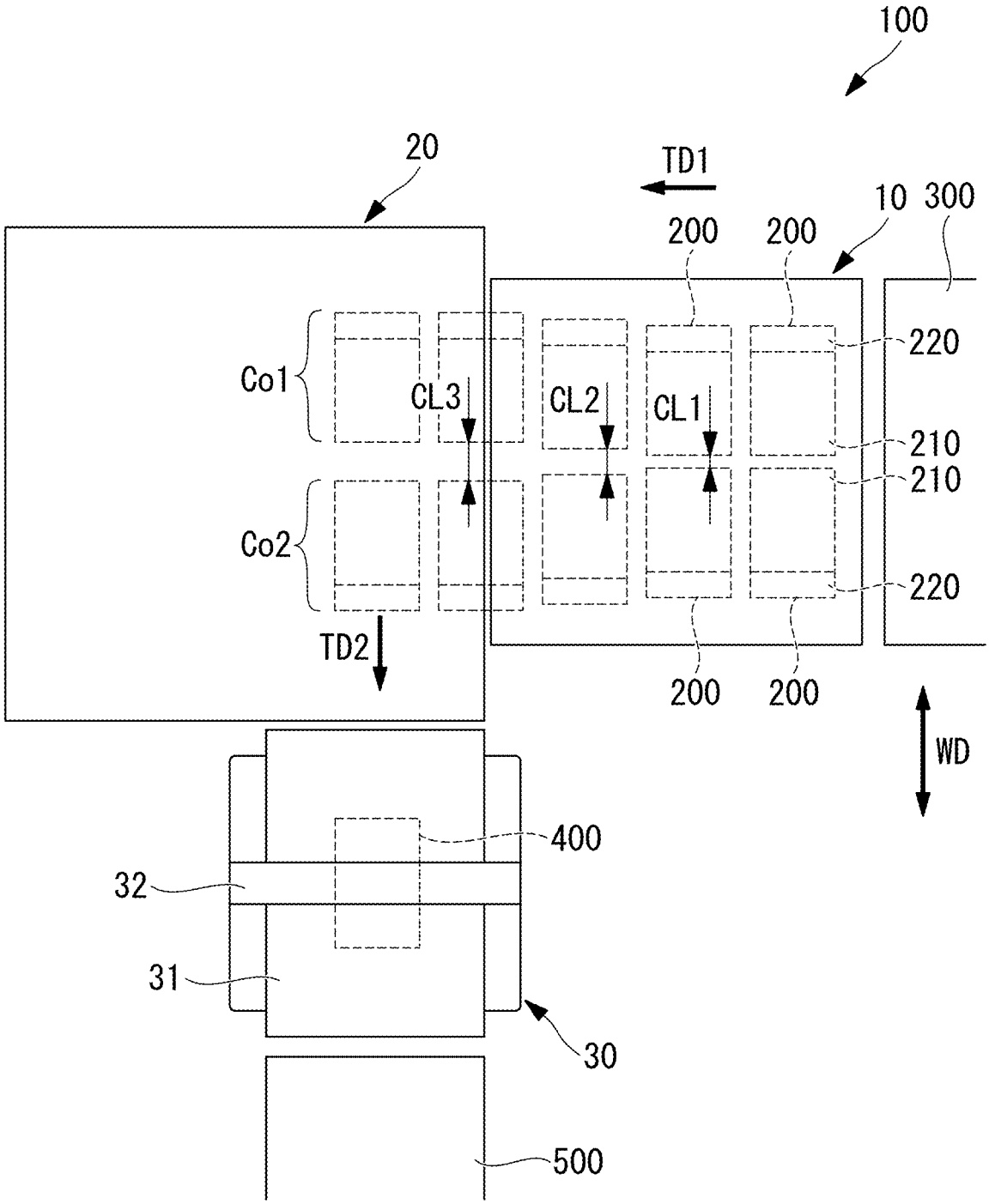
FIG. 2 is a plan view of the bag loading apparatus illustrated in FIG. 1 when viewed from above.
Figure 3:
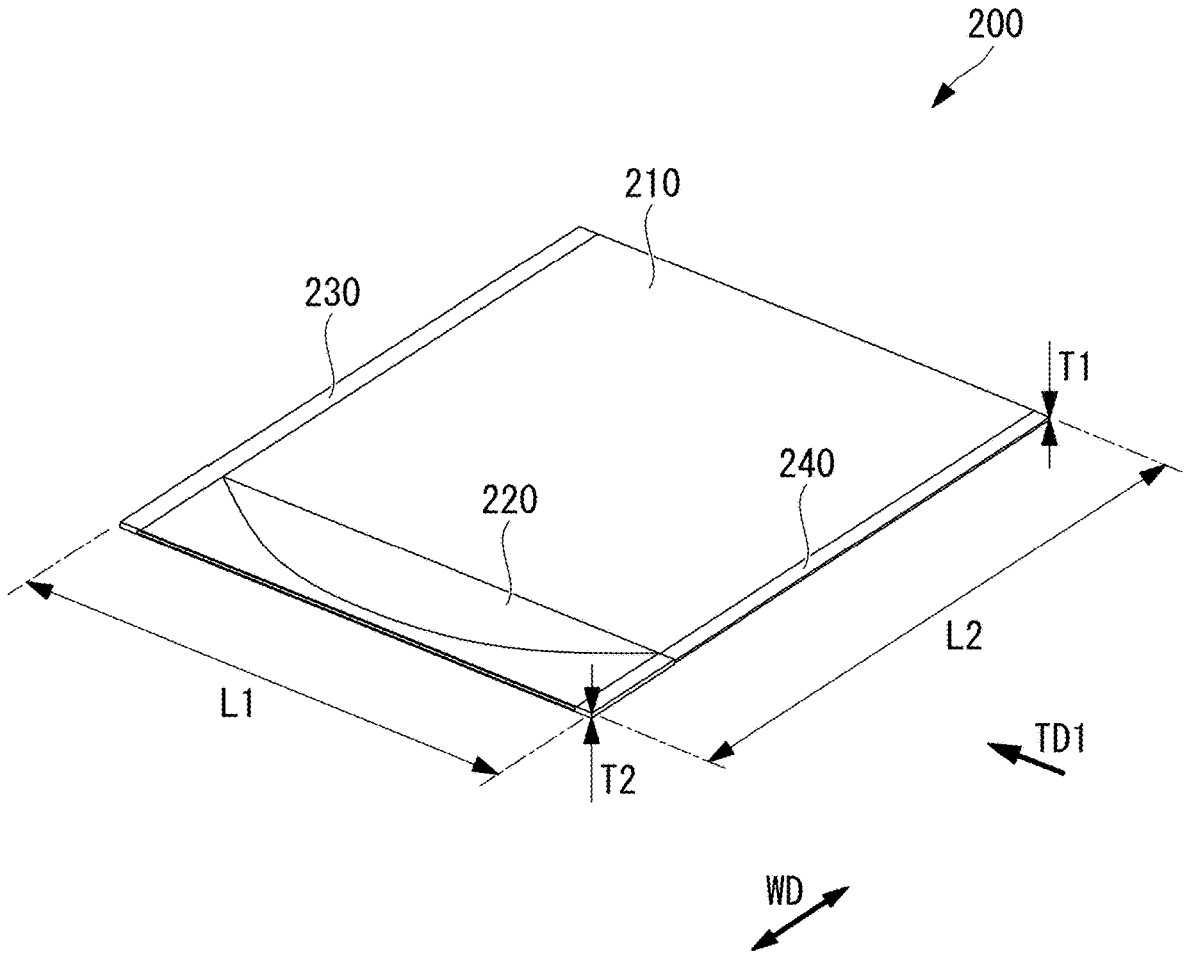
FIG. 3 is a perspective view of a bag illustrated in FIG. 1.

A bag loading apparatus 100 according to one embodiment of the present invention will be described with reference to the drawings. FIG. 1 is a perspective view illustrating the bag loading apparatus 100 according to one embodiment of the present invention. FIG. 2 is a plan view of the bag loading apparatus 100 illustrated in FIG. 1 when viewed from above. FIG. 3 is a perspective view of a bag 200 illustrated in FIG. 1.

The bag loading apparatus 100 of the present embodiment is an apparatus that loads a plurality of bags 200 manufactured by a bag-making machine 300 so as to stack these bags 200 and binds the stacked bags 200 with a banding band. As illustrated in FIG. 1, the bag loading apparatus 100 of the present embodiment includes a transport unit (transport device) 10, a loading unit 20, a bundling unit (bundling device) 30, and a control unit (a control device) 40.

The transport unit 10 is a device that transports the bags 200 in a transport direction TD1. As illustrated in FIG. 2, the transport unit 10 receives the bags 200 manufactured by the bag-making machine 300 and supplies the received bags 200 to the loading unit 20 along the transport direction TD1. As illustrated in FIG. 2, the transport unit 10 transports the bags 200 in a plurality of lines of a first line Co1 and a second line Co2 in the transport direction TD1.

As illustrated in FIG. 3, the bag 200 is a bag in which a pair of films are overlapped to form an opening 210 in one of the ends, a two-folded bottom member is inserted into the other end to form a bottom part 220, and both sides are joined to provide seal parts 230 and 240. Such a bag 200 is called a three-sided stand bag.

Since the bottom member is inserted in the bottom part 220 of the bag 200, the thickness T2 of the bottom part 220 is larger than the thickness T1 of the opening 210. As illustrated in FIG. 3, the bag 200 is transported by the transport unit 10 in a state where the direction in which the opening 210 and the bottom part 220 extend matches the transport direction TD1 and the direction in which the seal parts 230, 240 extends matches the width direction WD. In the bag 200, the length L2 in the width direction WD is longer than the length L1 in the transport direction TD1.

Although the bag 200 is a three-sided stand bag illustrated in FIG. 3 in the present embodiment, the bag loading apparatus 100 of the present embodiment can also transport and load bags having other shapes. For example, the bag may be a three-sided bag in which a pair of films are overlapped to form an opening on one side and the remaining three sides are joined to form seal parts. Further, the bag may be other bags having the bottom part thicker than the opening. Further, the bag may be bags having the same thickness of the opening and the bottom part. The bag loading apparatus 100 of the present embodiment is particularly effective when bags having the bottom part thicker than the opening are stacked and loaded and also effective when bags having the opening thicker than the bottom part are stacked and loaded.

Further, the present embodiment is also effective when bags having the same thickness of the opening and the bottom part are stacked and loaded. As described later, while the bags 200 are transported in two lines to the loading unit 20 by the transport unit 10, the bags 200 transported in the two lines can be accumulated as a single bundle 400 and bound with the bundling unit 30.

As illustrated in FIG. 2, the transport unit 10 transports the bags 200 in a state where the bag 200 in the first line Co1 and the bag 200 in the second line Co2 are adjacent to each other in the width direction WD at the same position in the transport direction TD1. The bag 200 in the first line Co1 and the bag 200 in the second line Co2 are arranged such that the opening 210 of the bag 200 in the first line Co1 and the opening 210 of the bag 200 in the second line Co2 are located close to each other in the width direction WD. Further, the bag 200 in the first line Co1 and the bag 200 in the second line Co2 are arranged such that the bottom part 220 of the bag 200 in the first line Co1 and the bottom part 220 of the bag 200 in the second line Co2 are located away from each other in the width direction WD.

The thickness of the bottom part 220 (one side in the width direction WD) of the bag 200 in the first line Co1 is larger than the thickness of the opening 210 (the other side in the width direction WD). The thickness of the opening 210 (one side in the width direction WD) of the bag 200 in the second line Co2 is smaller than the thickness of the bottom part 220 (the other side in the width direction WD). In such a way, the transport unit 10 transports a plurality of bags 200 in a state where the orientations of the opening 210 and the bottom part 220 of a pair of bags 200 adjacent to each other in the width direction WD are different from each other.

Figure 4:
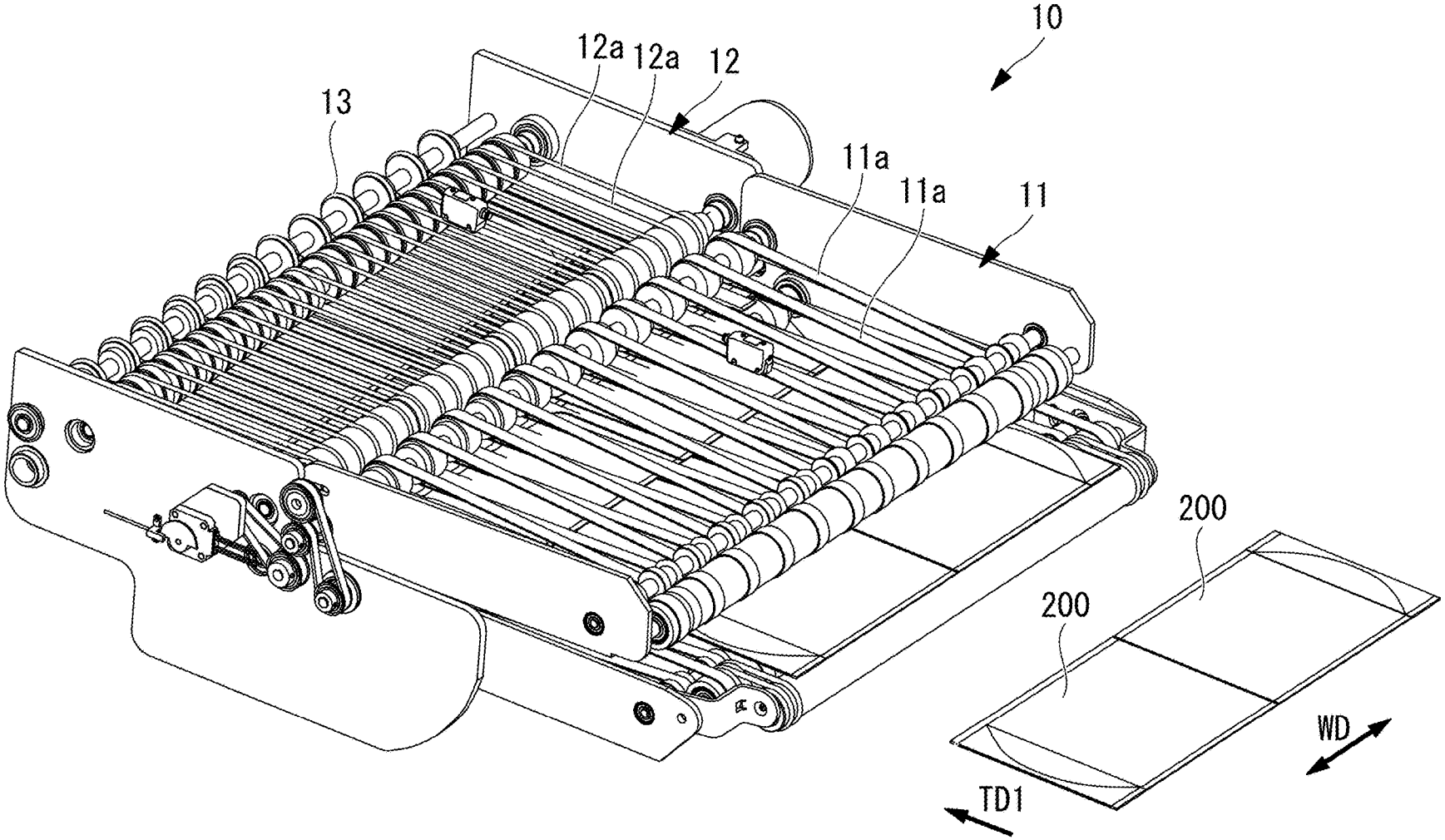
FIG. 4 is a perspective view of a transport unit illustrated in FIG. 1.

FIG. 4 is a perspective view of the transport unit 10 illustrated in FIG. 1. As illustrated in FIG. 4, the transport unit 10 includes a first conveyer 11, a second conveyer 12, and a feed-in roller 13.

The first conveyer 11 is a device that transports the bags 200 in the first line Co1 and the second line Co2 to the second conveyer 12, which are supplied in the transport direction TD1 from the bag-making machine 300. The first conveyer 11 causes resin belts 11*a* arranged at multiple positions in the width direction WD to be rotated in the transport direction TD1 and thereby transports the bags 200 to the second conveyer 12.

The second conveyer 12 is a device that transports the bags 200 of the first line Co1 and the second line Co2 that are supplied in the transport direction TD1 from the first conveyer 11, in the transport direction TD1 to the feed-in roller 13. The second conveyer 12 causes resin belts 12*a* arranged at multiple positions in the width direction WD to be rotated in the transport direction TD1 and thereby transports the bags 200 to the feed-in roller 13.

The belts 12*a* transport the bags 200 of the first line Co1 and the bags 200 of the second line Co2 such that the distance in the width direction WD between the bags 200 in the first line Co1 and the bags 200 in the second line Co2 increases as these bags 200 travel in the transport direction TD1. As illustrated in FIG. 2, the distance in the width direction WD between the bags 200 in the first line Co1 and the bags 200 in the second line Co2 supplied to the transport unit 10 from the bag-making machine 300 is CL1. The distance in the width direction WD between the bags 200 in the first line Co1 and the bags 200 in the second line Co2 is increased from CL1 to CL2 and increased from CL2 to CL3.

The feed-in roller 13 is a roller that transports the bags 200 of the first line Co1 and the second line Co2 to the loading unit 20 that are supplied in the transport direction TD1 from the second conveyer 12.

Figure 5:
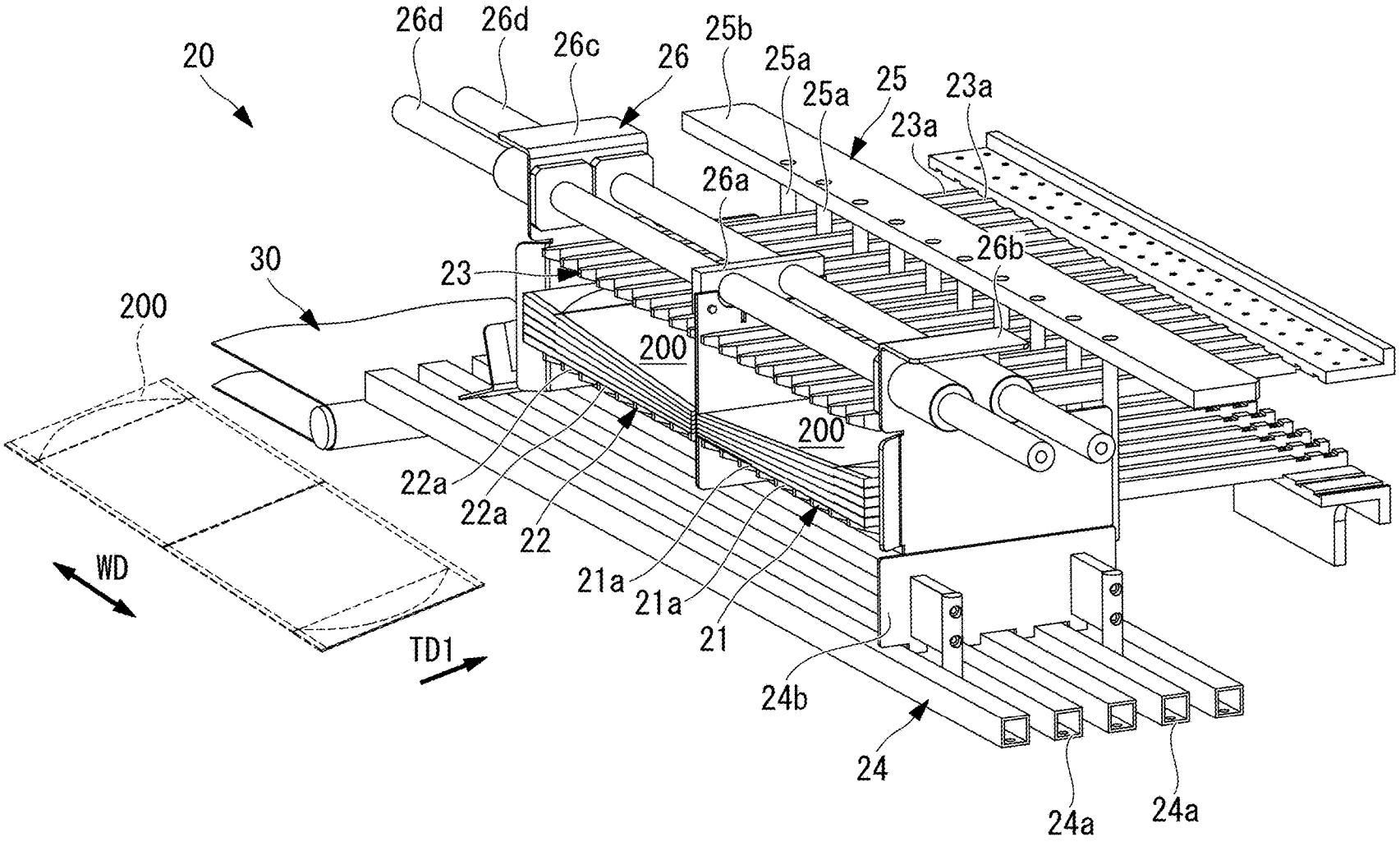
FIG. 5 is a perspective view of a loading unit illustrated in FIG. 1 and illustrates a state where a first loading mode is performed.
Figure 6:
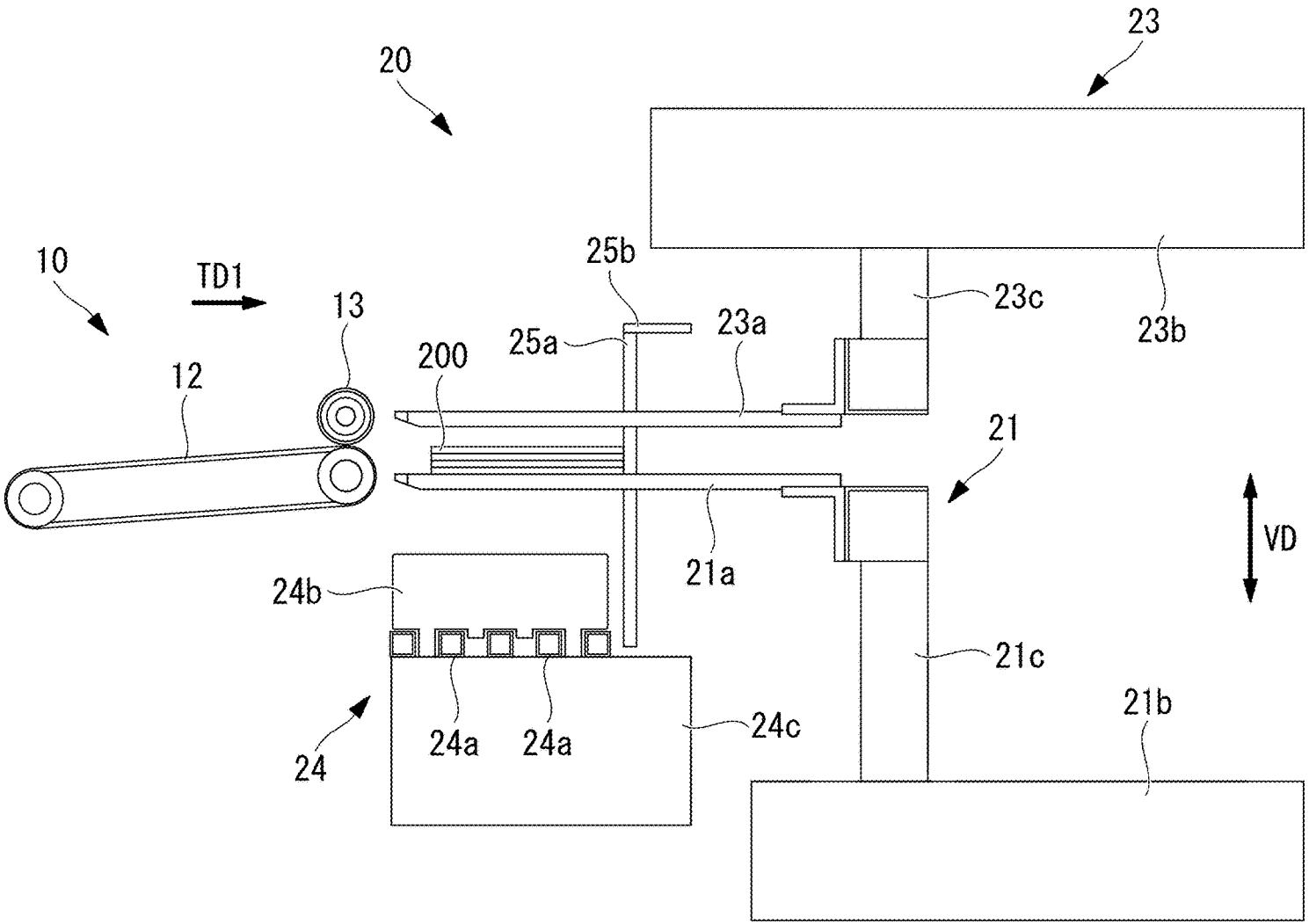
FIG. 6 is a right side view of the loading unit illustrated in FIG. 5.
Figure 7:
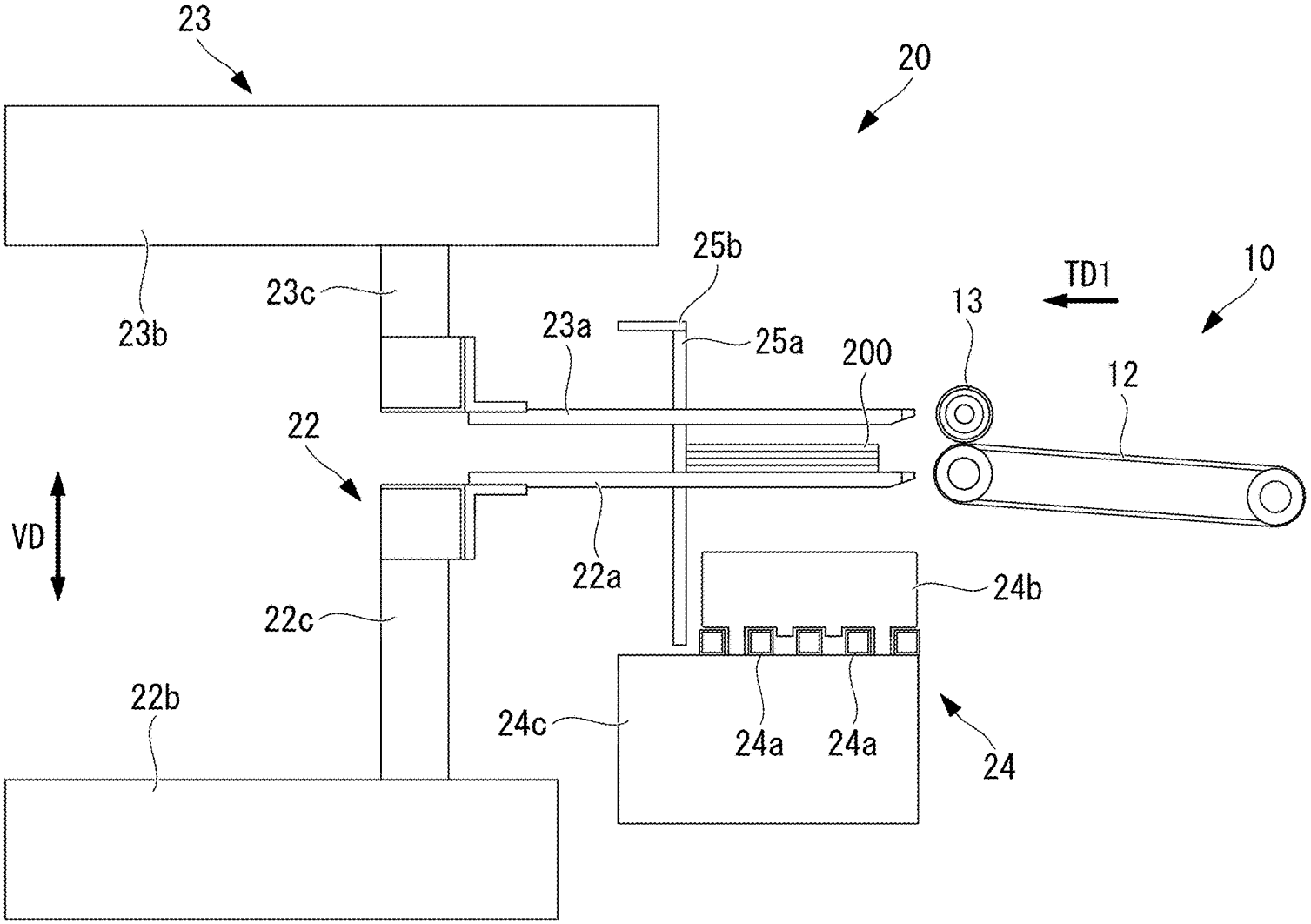
FIG. 7 is a left side view of the loading unit illustrated in FIG. 5.

The loading unit 20 is a device that loads a plurality of bags 200 transported from the transport unit 10 so as to stack these bags 200 and discharges a bundle 400 consisting of the plurality of bags 200 to the bundling unit 30. FIG. 5 is a perspective view of the loading unit 20 illustrated in FIG. 1 and illustrates a state where a first loading mode described later is performed. FIG. 6 is a right side view of the loading unit 20 illustrated in FIG. 5. FIG. 7 is a left side view of the loading unit 20 illustrated in FIG. 5.

As illustrated in FIG. 5, the loading unit 20 has a first loading unit 21, a second loading unit 22, a third loading unit 23, a discharge unit 24, a first guide 25, and a second guide 26.

The first loading unit 21 is a device that temporarily loads thereon the bags 200 of the first line Co1 transported by the transport unit 10. The first loading unit 21 is arranged at a position more distant from the bundling unit 30 than the second loading unit 22 in the width direction WD. As illustrated in FIG. 5, the first loading unit 21 has a plurality of forks 21*a* extending in the transport direction TD1 and formed in a bar-like shape. In the first loading unit 21, the plurality of forks 21*a* are arranged with intervals in the width direction WD, and thereby a loading face to load the bags 200 thereon is formed.

As illustrated in FIG. 6, the first loading unit 21 has a horizontal motion mechanism 21*b* that moves the plurality of forks 21*a* in the transport direction TD1 and a vertical motion mechanism 21*c* that moves the plurality of forks 21*a* in the vertical direction VD. The first loading unit 21 operates the horizontal motion mechanism 21*b* and the vertical motion mechanism 21*c* in accordance with control signals transmitted from the control unit 40.

The second loading unit 22 is a device that temporarily loads thereon the bags 200 of the second line Co2 transported by the transport unit 10. The second loading unit 22 is arranged at a position closer to the bundling unit 30 than the first loading unit 21 in the width direction WD. As illustrated in FIG. 5, the second loading unit 22 has a plurality of forks 22*a* extending in the transport direction TD1 and formed in a bar-like shape. In the second loading unit 22, the plurality of forks 22*a* are arranged with intervals in the width direction WD, and thereby a loading face to load the bags 200 thereon is formed.

As illustrated in FIG. 7, the second loading unit 22 has a horizontal motion mechanism 22*b* that moves the plurality of forks 22*a* in the transport direction TD1 and a vertical motion mechanism 22*c* that moves the plurality of forks 22*a* in the vertical direction VD. The second loading unit 22 operates the horizontal motion mechanism 22*b* and the vertical motion mechanism 22*c* in accordance with control signals transmitted from the control unit 40.

The third loading unit 23 is a device that temporarily loads thereon the bags 200 of the first line Co1 and the bags 200 of the second line Co2 transported by the transport unit 10. The third loading unit 23 is arranged above the first loading unit 21 and the second loading unit 22 in the vertical direction VD. As illustrated in FIG. 5 and FIG. 6, the third loading unit 23 has a plurality of forks 23*a* extending in the transport direction TD1 and formed in a bar-like shape. In the third loading unit 23, the plurality of forks 23*a* are arranged with intervals in the width direction WD, and thereby a loading face to load the bags 200 thereon is formed.

As illustrated in FIG. 6 and FIG. 7, the third loading unit 23 has a horizontal motion mechanism 23*b* that moves the plurality of forks 23*a* in the transport direction TD1 and a vertical motion mechanism 23*c* that moves the plurality of forks 23*a* in the vertical direction VD. The third loading unit 23 operates the horizontal motion mechanism 23*b* and the vertical motion mechanism 23*c* in accordance with control signals transmitted from the control unit 40.

The discharge unit 24 is a device that is arranged below the first loading unit 21 and the second loading unit 22 and loads the bags 200 dropped from the first loading unit 21 and the second loading unit 22. The discharge unit 24 handles the bags 200 dropped from the first loading unit 21 and the second loading unit 22 as a single bundle 400 and discharges the bundle 400 to the bundling unit 30 in a transport direction TD2 orthogonal to the transport direction TD1.

The discharge unit 24 has a plurality of cylindrical members 24*a* extending in the width direction WD, a discharge pusher 24*b*, and a slide mechanism 24*c*. In the discharge unit 24, the plurality of cylindrical members 24*a* are arranged with intervals along the transport direction TD1, and thereby a loading face to load the bags 200 thereon is formed.

The discharge pusher 24*b* is a plate-like member arranged so as to extend in the vertical direction VD. The discharge pusher 24*b* is driven by the slide mechanism 24*c* and thereby moved in the width direction WD. The discharge pusher 24*b* moves a plurality of bags 200, which were dropped from the first loading unit 21, to an area under the second loading unit 22. Further, the discharge pusher 24*b* discharges the bundle 400 to the bundling unit 30, and in the bundle 400, the bags 200 that were dropped from the second loading unit 22 are stacked on the bags 200 that were moved to the area under the second loading unit 22.

The first guide 25 is a member for positioning the bags 200 in the transport direction TD1 that are transported to the loading unit 20 in the transport direction TD1. The first guide 25 has a plurality of pin guides 25*a* extending in the vertical direction VD and a pin bracket 25*b* to which the plurality of pin guides 25*a* are connected. The plurality of pin guides 25*a* are arranged with intervals in the width direction WD. The plurality of pin guides 25*a* are arranged to penetrate in the vertical direction VD between the plurality of forks 21*a*, between the plurality of forks 22*a*, and between the plurality of forks 23*a*.

The bag 200 transported from the transport unit 10 to the first loading unit 21 is positioned in the transport direction TD1 when the front edge of the bag 200 comes into contact with the pin guides 25*a*. The bag 200 transported from the transport unit 10 to the second loading unit 22 is positioned in the transport direction TD1 when the front edge of the bag 200 comes into contact with the pin guides 25*a*. The bag 200 transported from the transport unit 10 to the third loading unit 23 is positioned in the transport direction TD1 when the front edge of the bag 200 comes into contact with the pin guides 25*a*.

The second guide 26 is a member for positioning the bags 200 in the width direction WD that are transported to the loading unit 20 in the transport direction TD1. The second guide 26 has a center guide plate 26*a*, a lateral alignment guide plate 26*b*, a lateral alignment guide plate 26*c*, and a pair of slide shafts 26*d*. The pair of slide shafts 26*d* are inserted in the center guide plate 26*a*, the lateral alignment guide plate 26*b*, and the lateral alignment guide plate 26*c*.

The second guide 26 moves the lateral alignment guide plate 26*b* toward the center guide plate 26*a* in the width direction WD by using the first motion mechanism (not illustrated) and thereby positions the bags 200 of the first line Co1 in the width direction WD. Further, the second guide 26 moves the lateral alignment guide plate 26*c* toward the center guide plate 26*a* in the width direction WD by using the second motion mechanism (not illustrated) and thereby positions the bags 200 of the second line Co2 in the width direction WD.

The bundling unit 30 is a device that uses a banding band 410 to bind the bundle 400 in which a plurality of bags 200 of the first line Co1 and a plurality of bags 200 of the second line Co2 are stacked on each other. As illustrated in FIG. 1, the bundling unit 30 has a transport conveyer 31 and a bundling mechanism 32.

As illustrated in FIG. 1 and FIG. 2, the transport conveyer 31 is a device that transports, in the transport direction TD2, the bundle 400 discharged from the discharge unit 24 of the loading unit 20. The transport conveyer 31 transports the bundle 400 in the transport direction TD2 and temporarily stops the bundle 400 at a position where the bundling mechanism 32 is arranged. The bundling mechanism 32 binds the bundle 400 with the banding band 410 (for example, a resin tape, a paper tape, or the like). The bundle 400 bound with the banding band 410 by the bundling mechanism 32 is transported in the transport direction TD2 by the transport conveyer 31 and supplied to the accumulation unit 500.

The control unit 40 is a device that controls the bag loading apparatus 100. The control unit 40 controls each device of the bag loading apparatus 100 including the transport unit 10, the loading unit 20, and the bundling unit 30. The control unit 40 performs control to switch the mode between a first loading mode and a second loading mode, the first loading mode is to load the bags 200 transported by the transport unit 10 on the first loading unit 21 and the second loading unit 22, and the second loading mode is to load the bags 200 transported by the transport unit 10 on the third loading unit 23.

The control unit 40 is formed of, for example, a central processing unit (CPU), a random access memory (RAM), a read only memory (ROM), a computer readable storage medium, and the like. Further, a series of processes for implementing various functions are stored in a storage medium or the like in a form of a program as an example, and the various functions are implemented when the CPU loads such a program into the RAM or the like to perform modification or computation processing on information. Note that, for a program, a form in which the program is installed in advance in the ROM or another storage medium, a form in which the program is provided stored in a computer readable storage medium, a form in which the program is delivered via a wired or wireless communication connection, or the like may be applied. The computer readable storage medium may be a magnetic disk, a magneto-optical disk, a CD-ROM, a DVD-ROM, a semiconductor memory, or the like.

Figure 8:
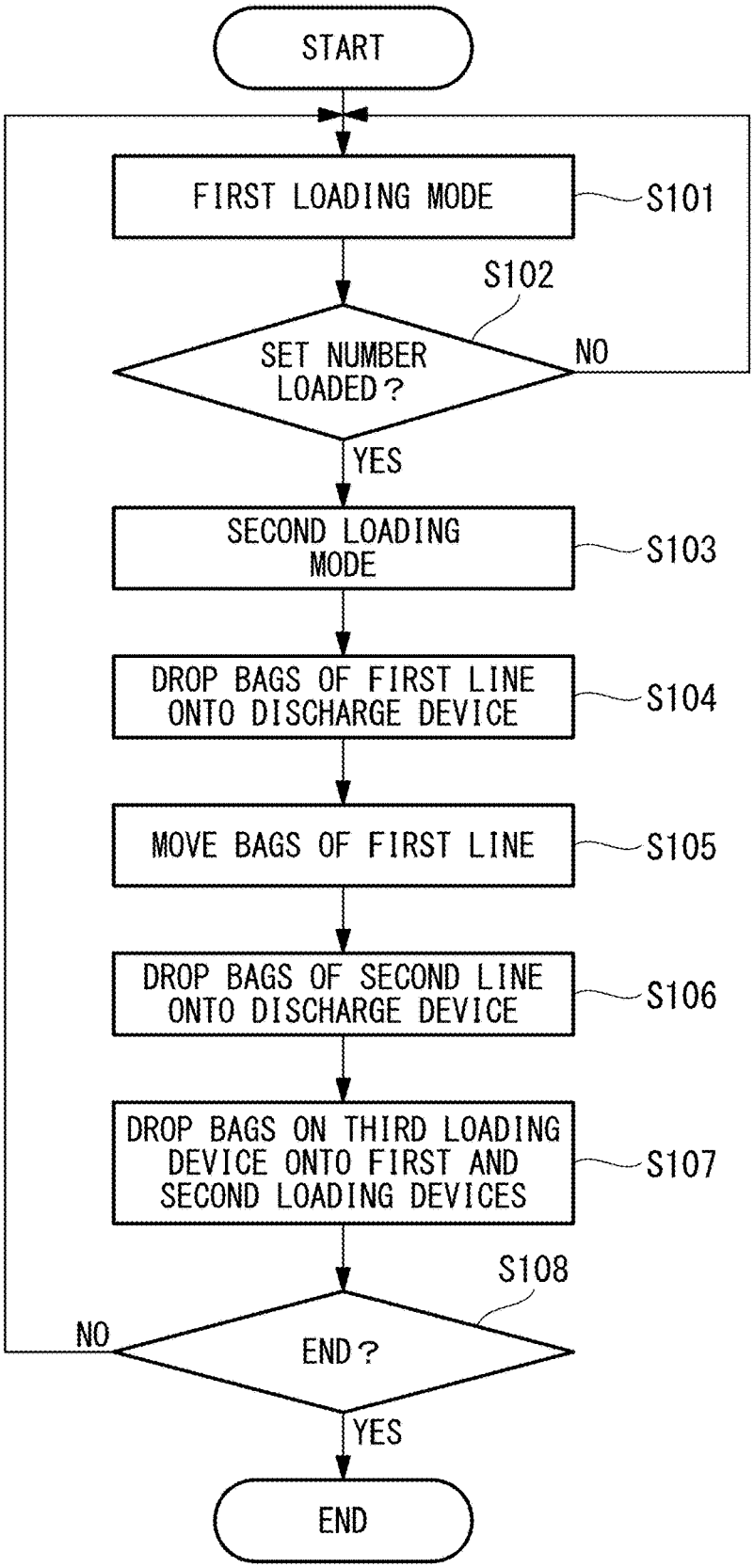
FIG. 8 is a flowchart illustrating a control method of the bag loading apparatus according to one embodiment of the present invention.

Next, a control method of the bag loading apparatus 100 performed by the control unit 40 of the present embodiment will be described with reference to FIG. 8. FIG. 8 is a flowchart illustrating a control method of the bag loading apparatus 100 according to one embodiment of the present invention.

In step S101 (transport step), the control unit 40 controls the transport unit 10, the first loading unit 21, the second loading unit 22, and the third loading unit 23 to perform the first loading mode. The first loading mode is a mode to load the bags 200 transported by the transport unit 10 on the first loading unit 21 and the second loading unit 22.

As illustrated in FIG. 6 and FIG. 7, the control unit 40 adjusts the positions in the vertical direction VD of the first loading unit 21, the second loading unit 22, and the third loading unit 23 so that the bags 200 supplied to the loading unit 20 by the feed-in roller 13 are loaded on the first loading unit 21 and the second loading unit 22. The control unit 40 transfers control signals to the vertical motion mechanism 21*c*, the vertical motion mechanism 22*c*, and the vertical motion mechanism 23*c* so as to adjust the positions in the vertical direction VD of the first loading unit 21, the second loading unit 22, and the third loading unit 23.

In step S102, the control unit 40 determines whether or not a preset set number of bags 200 have been loaded on the first loading unit 21 and the second loading unit 22 and proceeds with the process to step S103 if the determination is YES or performs the process of step S101 again if the determination is NO.

In step S103, the control unit 40 controls the first loading unit 21, the second loading unit 22, and the third loading unit 23 to perform the second loading mode. The second loading mode is a mode to load the bags 200 transported by the transport unit 10 on the third loading unit 23.

Figure 9:
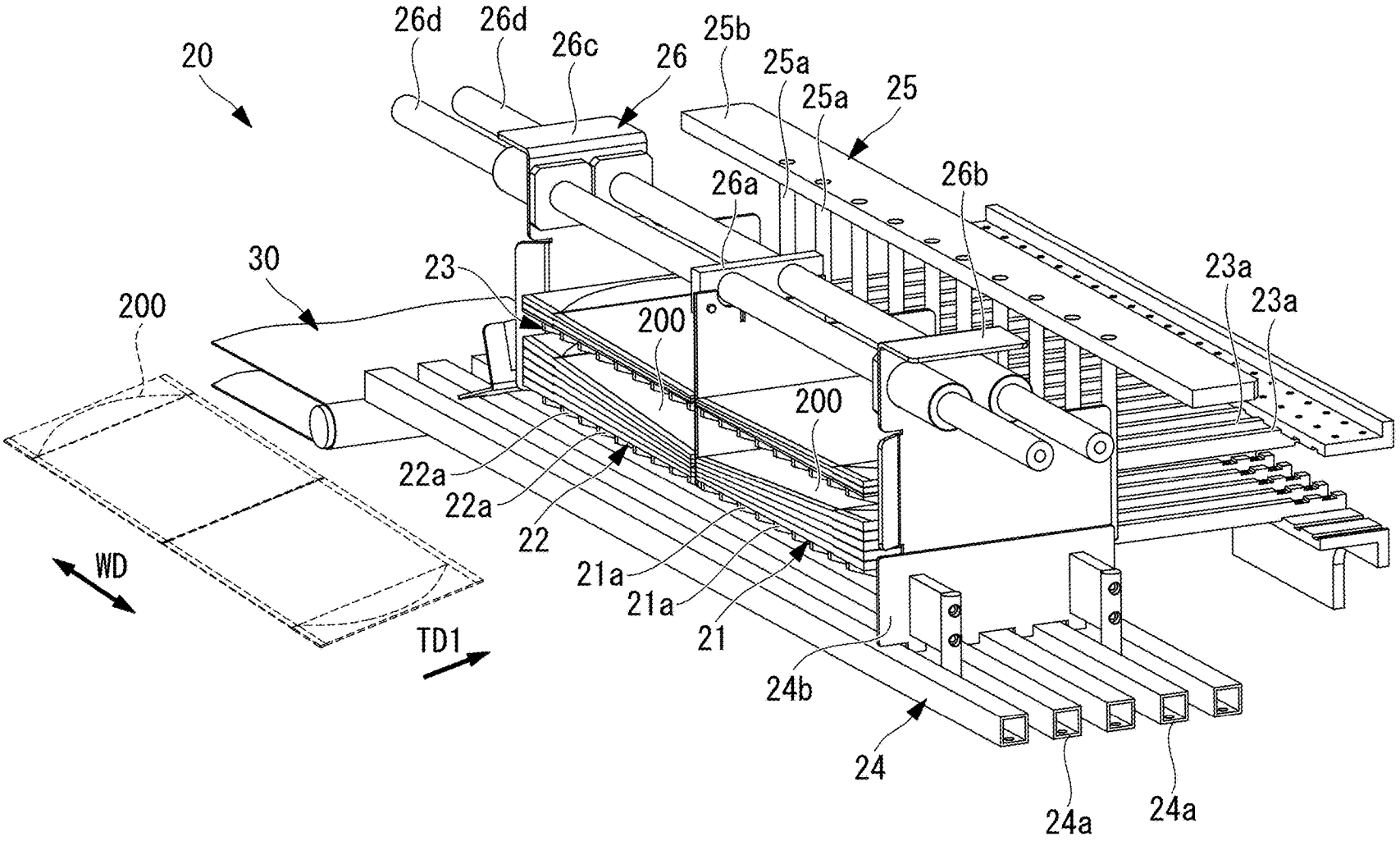
FIG. 9 is a perspective view of the loading unit illustrated in FIG. 1 and illustrates a state where a second loading mode is performed.
Figure 10:
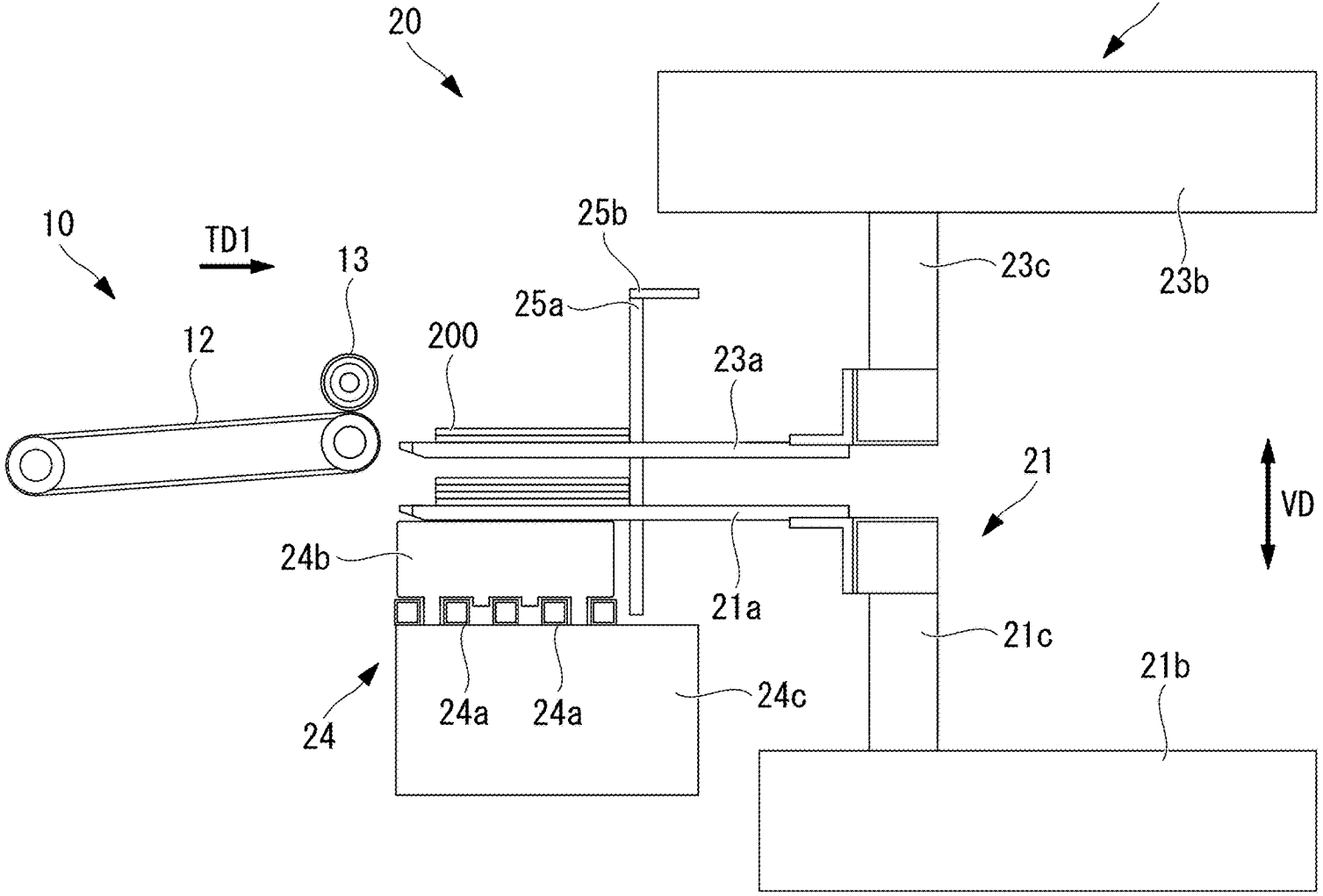
FIG. 10 is a side view of the loading unit illustrated in FIG. 9.

FIG. 9 is a perspective view of the loading unit 20 illustrated in FIG. 1 and illustrates a state where the second loading mode is performed. FIG. 10 is a side view of the loading unit 20 illustrated in FIG. 9. As illustrated in FIG. 9 and FIG. 10, the control unit 40 adjusts the positions in the vertical direction VD of the first loading unit 21, the second loading unit 22, and the third loading unit 23 so that the bags 200 supplied to the loading unit 20 by the feed-in roller 13 are loaded on the third loading unit 23. The control unit 40 transfers control signals to the vertical motion mechanism 21*c*, the vertical motion mechanism 22*c*, and the vertical motion mechanism 23*c* so as to adjust the positions in the vertical direction VD of the first loading unit 21, the second loading unit 22, and the third loading unit 23.

In step S104 (first drop step), the control unit 40 controls the first loading unit 21 to drop a plurality of bags 200 of the first line Co1 from the first loading unit 21 to the discharge unit 24. The control unit 40 controls the horizontal motion mechanism 21*b* to move the plurality of forks 21*a* away from the first guide 25 in the transport direction TD1.

Even when the plurality of forks 21*a* are moved away from the first guide 25 in the transport direction TD1, the bags 200 do not move in the transport direction TD1. This is because motion of the bags 200 in the transport direction TD1 is restricted by the first guide 25. When the plurality of forks 21*a* are pulled out from the first guide 25, the bags 200 loaded on the plurality of forks 21*a* are dropped onto the discharge unit 24.

Figure 11:
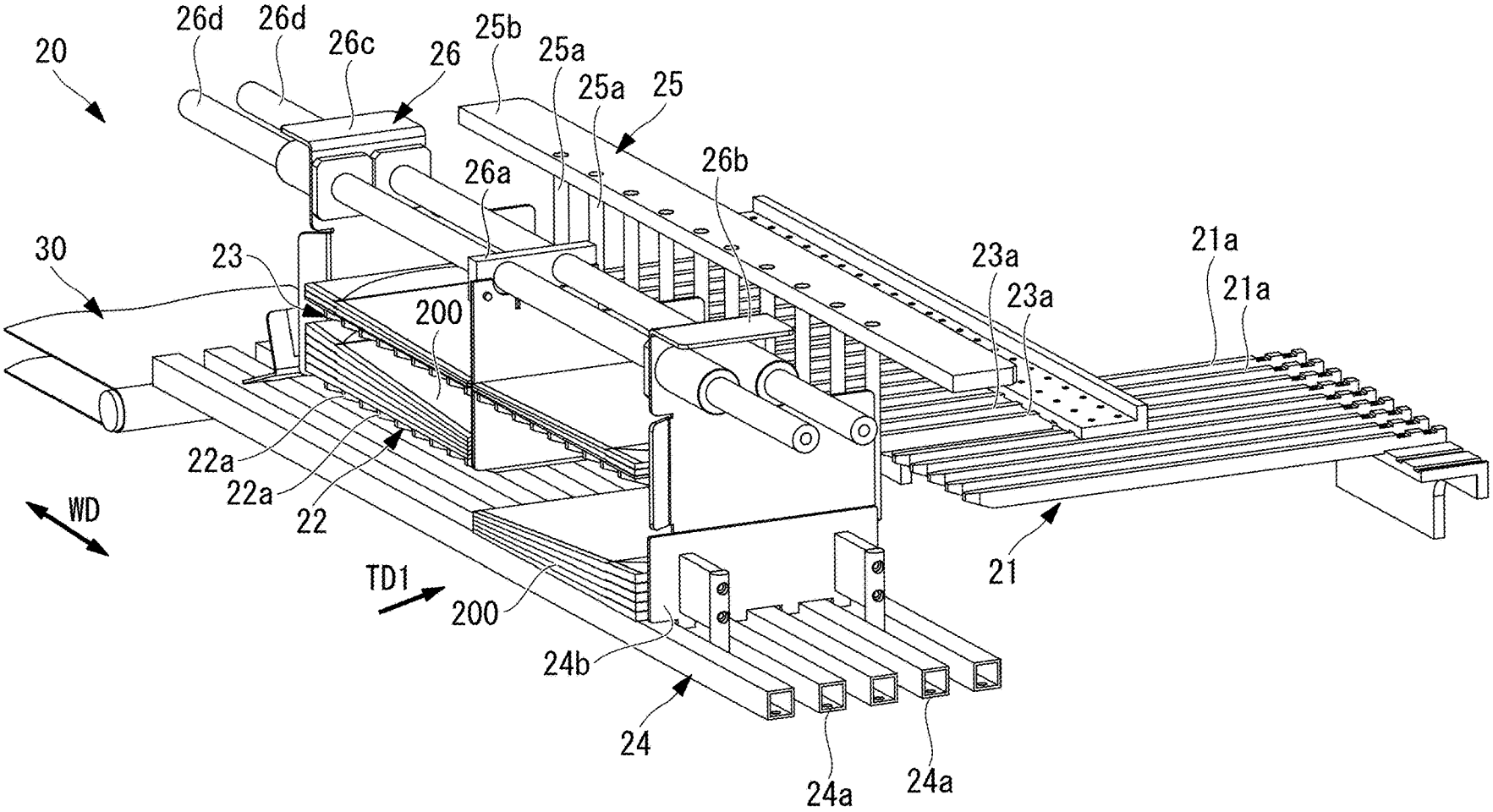
FIG. 11 is a perspective view of the loading unit illustrated in FIG. 1 and illustrates a state where bags were dropped from a first loading unit to a discharge unit.
Figure 12:
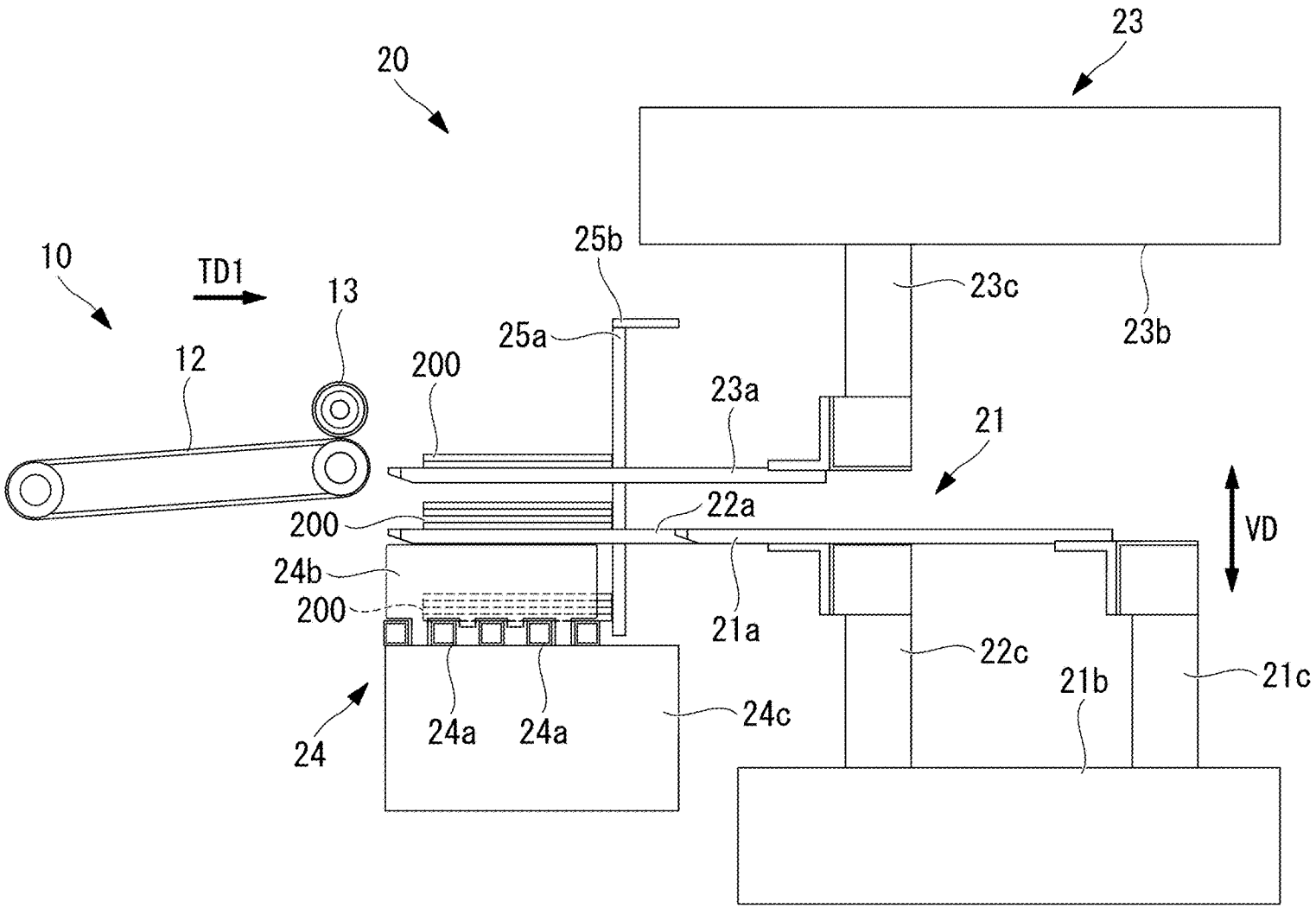
FIG. 12 is a side view of the loading unit illustrated in FIG. 11.

In response to the bags 200 loaded on the plurality of forks 21*a* being dropped onto the discharge unit 24, the state illustrated in FIG. 11 and FIG. 12 is resulted. FIG. 11 is a perspective view of the loading unit 20 illustrated in FIG. 1 and illustrates the state where the bags 200 were dropped from the first loading unit 21 to the discharge unit 24. FIG. 12 is a side view of the loading unit 20 illustrated in FIG. 11. After dropping the bags 200 loaded on the plurality of forks 21*a* onto the discharge unit 24, the control unit 40 controls the horizontal motion mechanism 21*b* to move the plurality of forks 21*a* back to the position illustrated in FIG. 10.

In step S105 (motion step), the control unit 40 controls the discharge unit 24 to move the plurality of bags 200 of the first line Co1 dropped onto the discharge unit 24 to an area under the plurality of bags 200 of the second line Co2 loaded on the second loading unit 22. The control unit 40 controls the slide mechanism 24*c* to move the discharge pusher 24*b* in the width direction WD and moves the plurality of bags 200 dropped from the first loading unit 21 to the area under the second loading unit 22.

Figure 13:
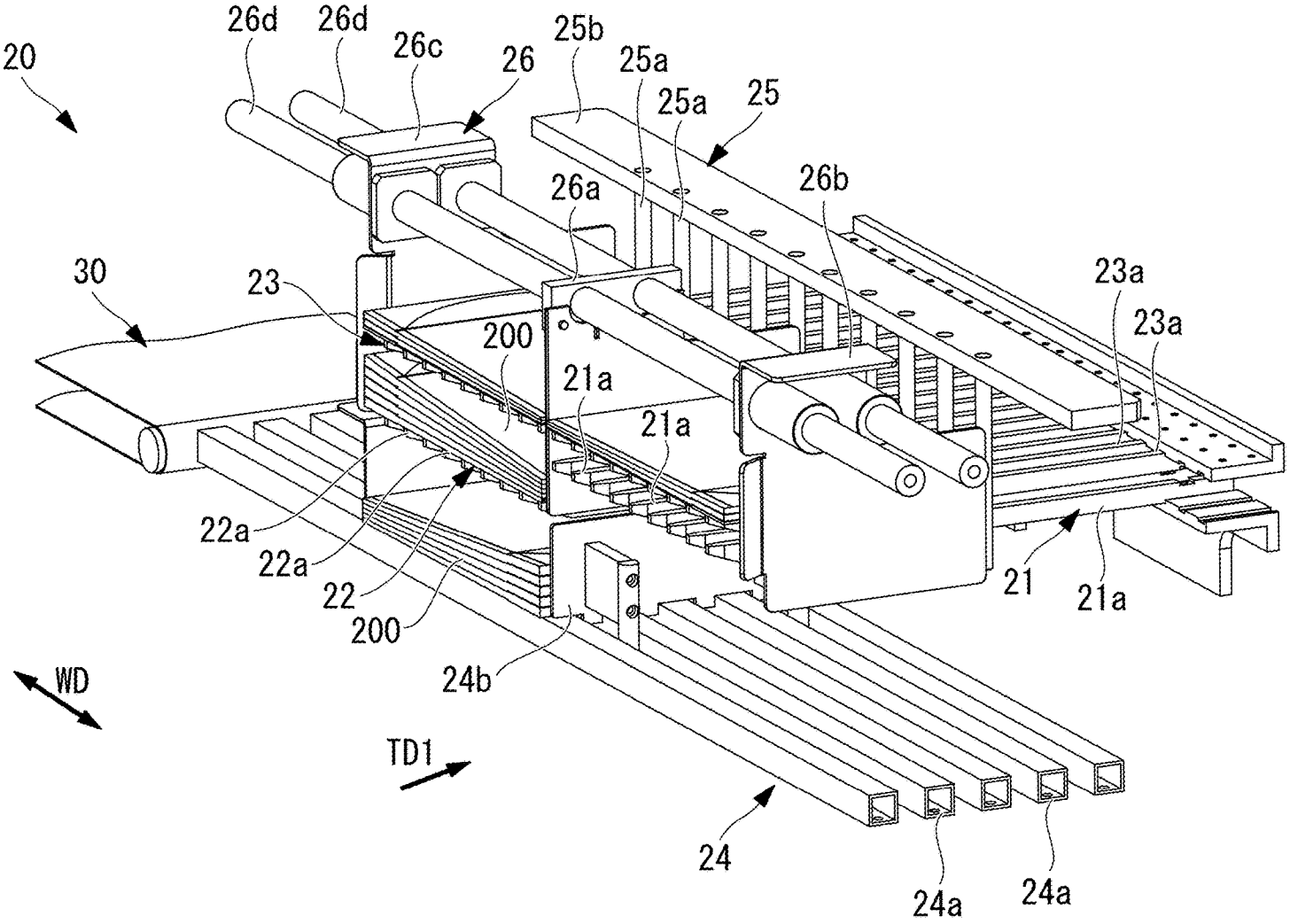
FIG. 13 is a perspective view of the loading unit illustrated in FIG. 1 and illustrates a state where the bags were moved from an area under the first loading unit to an area under a second loading unit.

In response to the plurality of bags 200 dropped from the first loading unit 21 being moved to the area under the second loading unit 22, the state illustrated in FIG. 13 is resulted. FIG. 13 is a perspective view of the loading unit 20 illustrated in FIG. 1 and illustrates the state where the bags 200 were moved from an area under the first loading unit 21 to the area under the second loading unit 22.

In step S106 (second drop step), the control unit 40 controls the second loading unit 22 to drop the plurality of bags 200 of the second line Co2 from the second loading unit 22 onto the plurality of bags 200 of the first line Co1. The control unit 40 controls the horizontal motion mechanism 22*b* to move the plurality of forks 22*a* away from the first guide 25 in the transport direction TD1.

Even when the plurality of forks 22*a* are moved away from the first guide 25 in the transport direction TD1, the bags 200 do not move in the transport direction TD1. This is because motion of the bags 200 in the transport direction TD1 is restricted by the first guide 25. When the plurality of forks 22*a* are pulled out from the first guide 25, the bags 200 loaded on the plurality of forks 22*a* are dropped onto the discharge unit 24.

Figure 14:
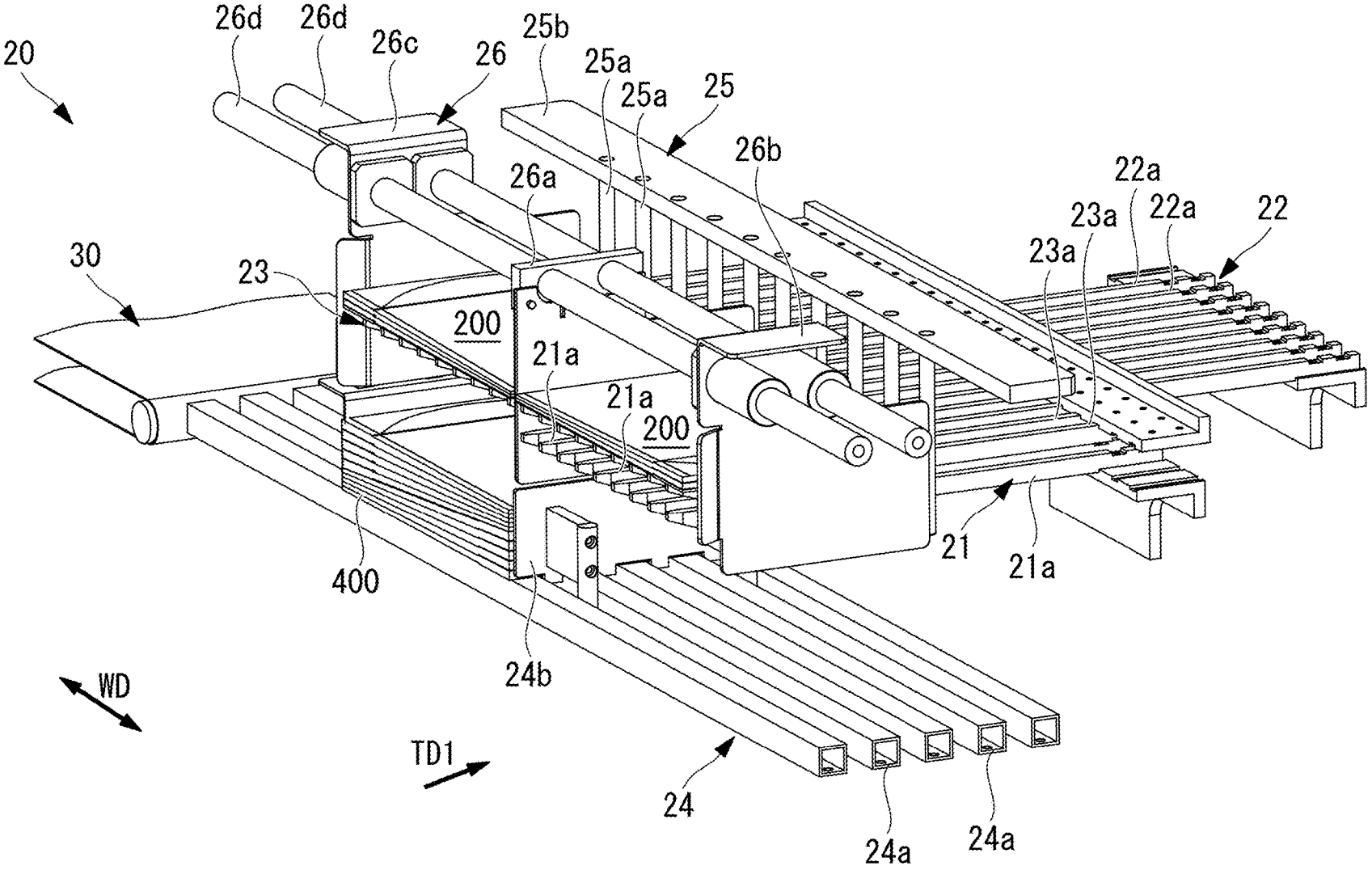
FIG. 14 is a perspective view of the loading unit illustrated in FIG. 1 and illustrates a state where the bags were dropped from the second loading unit to the discharge unit.
Figure 15:
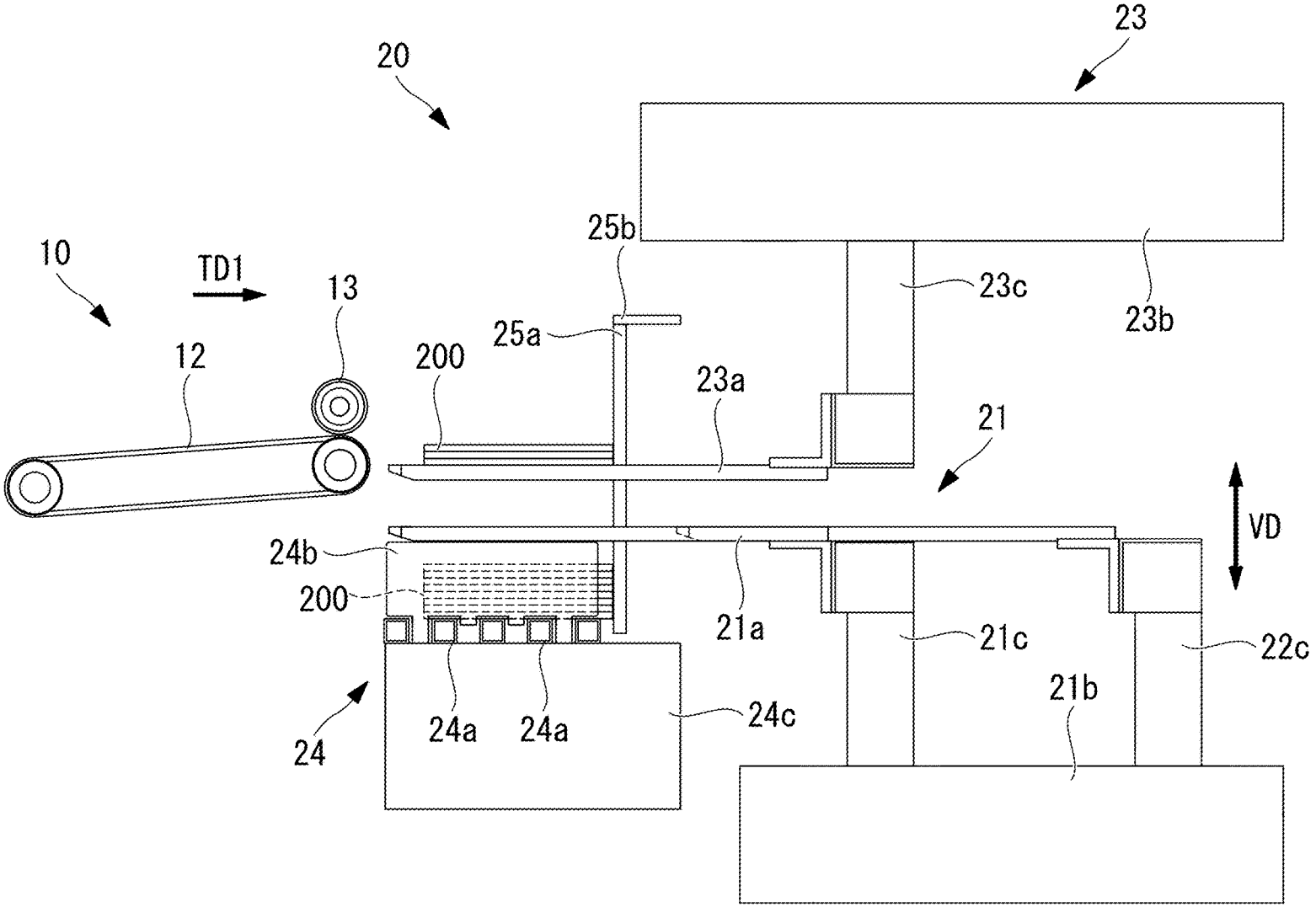
FIG. 15 is a side view of the loading unit illustrated in FIG. 14.

In response to the bags 200 loaded on the plurality of forks 22*a* being dropped onto the discharge unit 24, the state illustrated in FIG. 14 and FIG. 15 is resulted. FIG. 14 is a perspective view of the loading unit 20 illustrated in FIG. 1 and illustrates the state where the bags 200 were dropped from the second loading unit 22 to the discharge unit 24. FIG. 15 is a side view of the loading unit 20 illustrated in FIG. 14. After dropping the bags 200 loaded on the plurality of forks 22*a* onto the discharge unit 24, the control unit 40 controls the horizontal motion mechanism 22*b* to move the plurality of forks 22*a* back to the position illustrated in FIG. 7.

Figure 16:
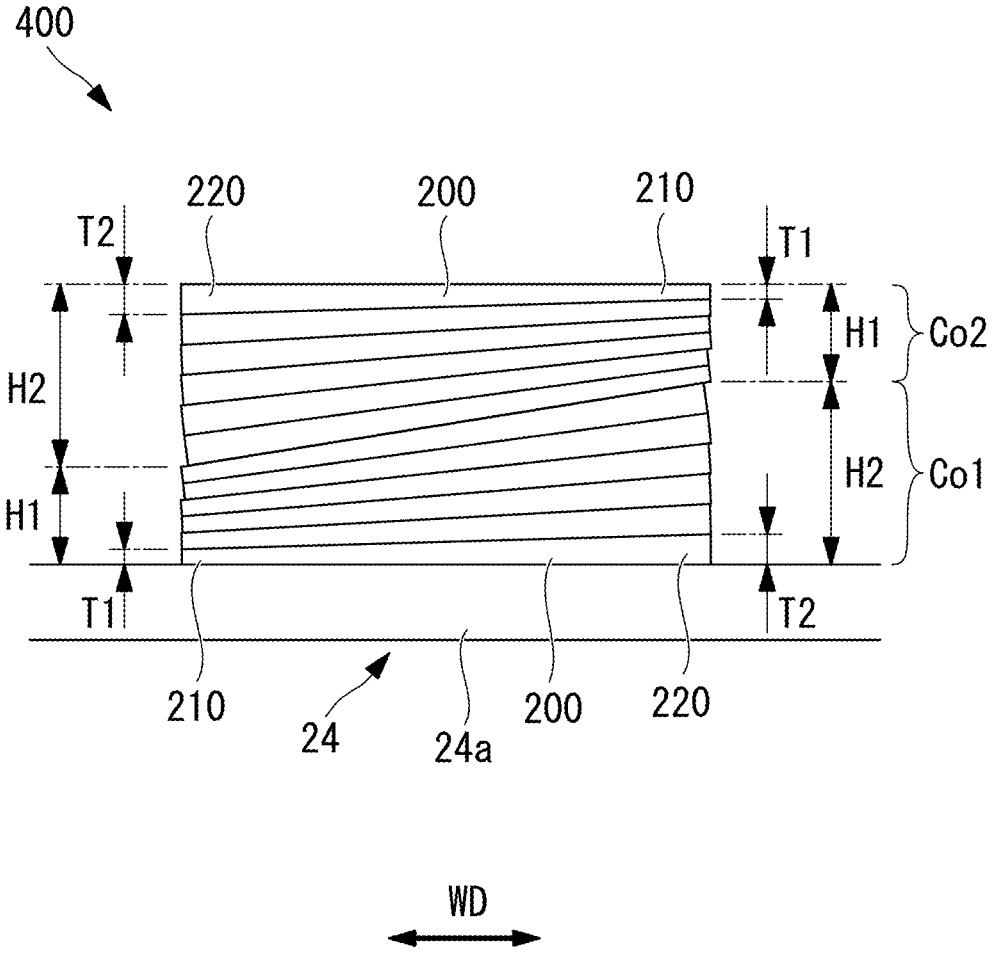
FIG. 16 is a diagram of a bundle illustrated in FIG. 14 when viewed from the transport unit side.

FIG. 16 is a diagram of the bundle 400 illustrated in FIG. 14 when viewed from the transport unit 10 side. As illustrated in FIG. 16, in the plurality of bags 200 of the first line Co1 loaded on underside of the discharge unit 24, the openings 210 are arranged on the left side in the width direction WD, and the bottom parts 220 are arranged on the right side thereof. In the bag 200, the thickness T2 of the bottom part 220 is larger than the thickness T1 of the opening 210. Thus, while the height of a stack of a plurality of (six in the example illustrated in FIG. 16) bags 200 of the first line Co1 is H1 on the opening 210 side, the height is H2, which is larger than H1, on the bottom part 220 side.

On the other hand, in the plurality of bags 200 of the second line Co2 loaded on upper side of the discharge unit 24, the openings 210 are arranged on the right side in the width direction WD, and the bottom parts 220 are arranged on the left side. Thus, while the height of a stack of a plurality of (six in the example illustrated in FIG. 16) bags 200 of the second line Co2 is H1 on the opening 210 side, the height is H2, which is larger than H1, on the bottom part 220 side.

When the plurality of bags 200 of the second line Co2 are then stacked on the plurality of bags 200 of the first line Co1, the height on the right side in the width direction WD is the sum of H1 and H2, and the height on the left side in the width direction WD is also the sum of H1 and H2. Therefore, the height of the bundle 400 is the same on both the right side and the left side in the width direction WD, and the bundle 400 has an even height over the entire area.

Figure 17:
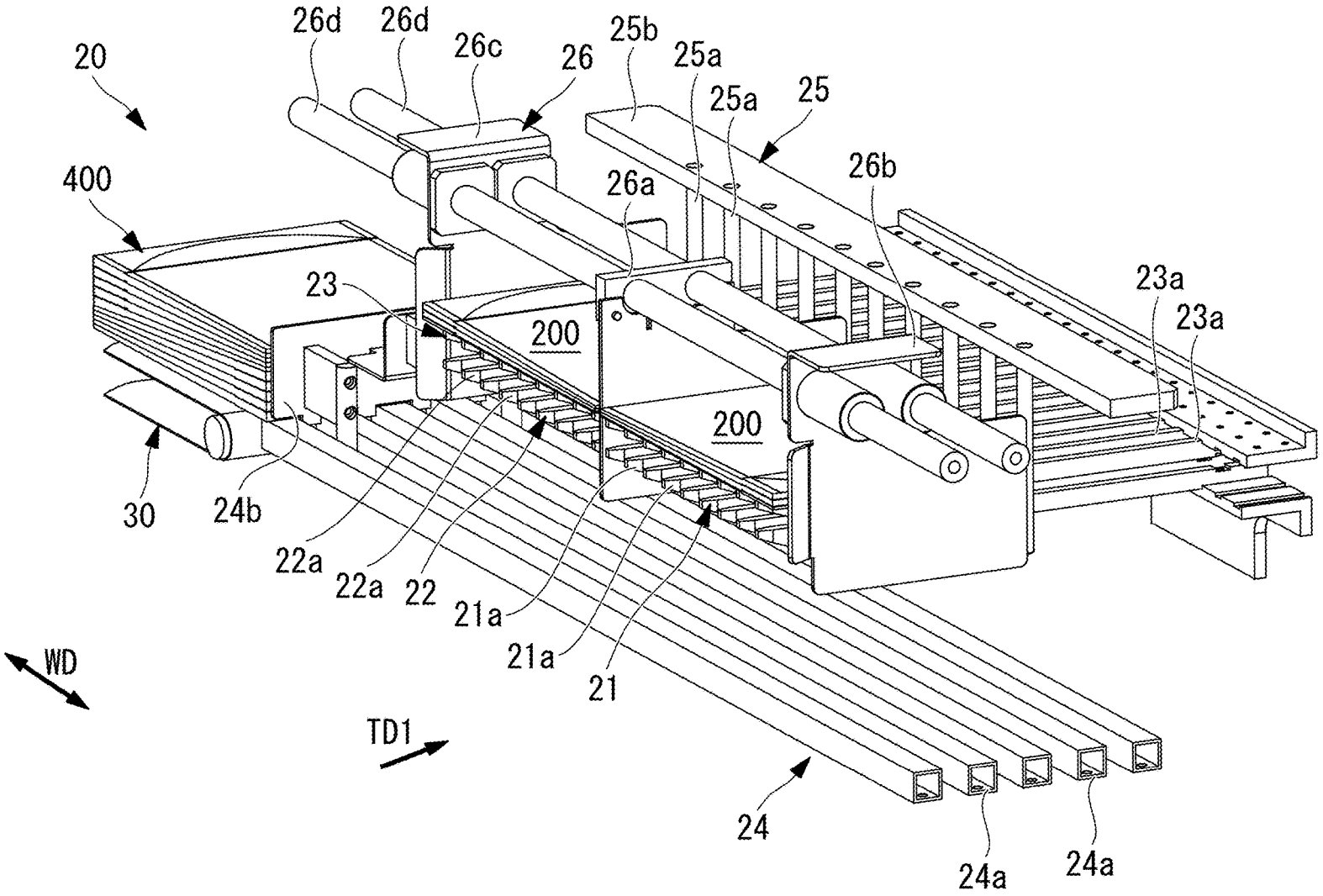
FIG. 17 is a perspective view of the loading unit illustrated in FIG. 1 and illustrates a state where the bundle was discharged from the discharge unit to a bundling unit.

The control unit 40 controls the discharge unit 24 to discharge the bundle 400 of the plurality of bags 200 of the second line Co2 stacked on the plurality of bags 200 of the first line Co1 out from the discharge unit 24 to the bundling unit 30. In response to the bundle 400 being discharged to the bundling unit 30, the state illustrated in FIG. 17 is resulted. FIG. 17 is a perspective view of the loading unit 20 illustrated in FIG. 1 and illustrates the state where the bundle 400 was discharged from the discharge unit 24 to the bundling unit 30.

In step S107 (third drop step), the control unit 40 controls the third loading unit 23 to drop the plurality of bags 200 loaded on the third loading unit 23 onto the first loading unit 21 and the second loading unit 22. The control unit 40 controls the horizontal motion mechanism 23*b* to move the plurality of forks 23*a* away from the first guide 25 in the transport direction TD1.

Even when the plurality of forks 23*a* are moved away from the first guide 25 in the transport direction TD1, the bags 200 do not move in the transport direction TD1. This is because motion of the bags 200 in the transport direction TD1 is restricted by the first guide 25. When the plurality of forks 23*a* are pulled out from the first guide 25, the bags 200 loaded on the plurality of forks 23*a* are dropped onto the first loading unit 21 and the second loading unit 22.

Figure 18:
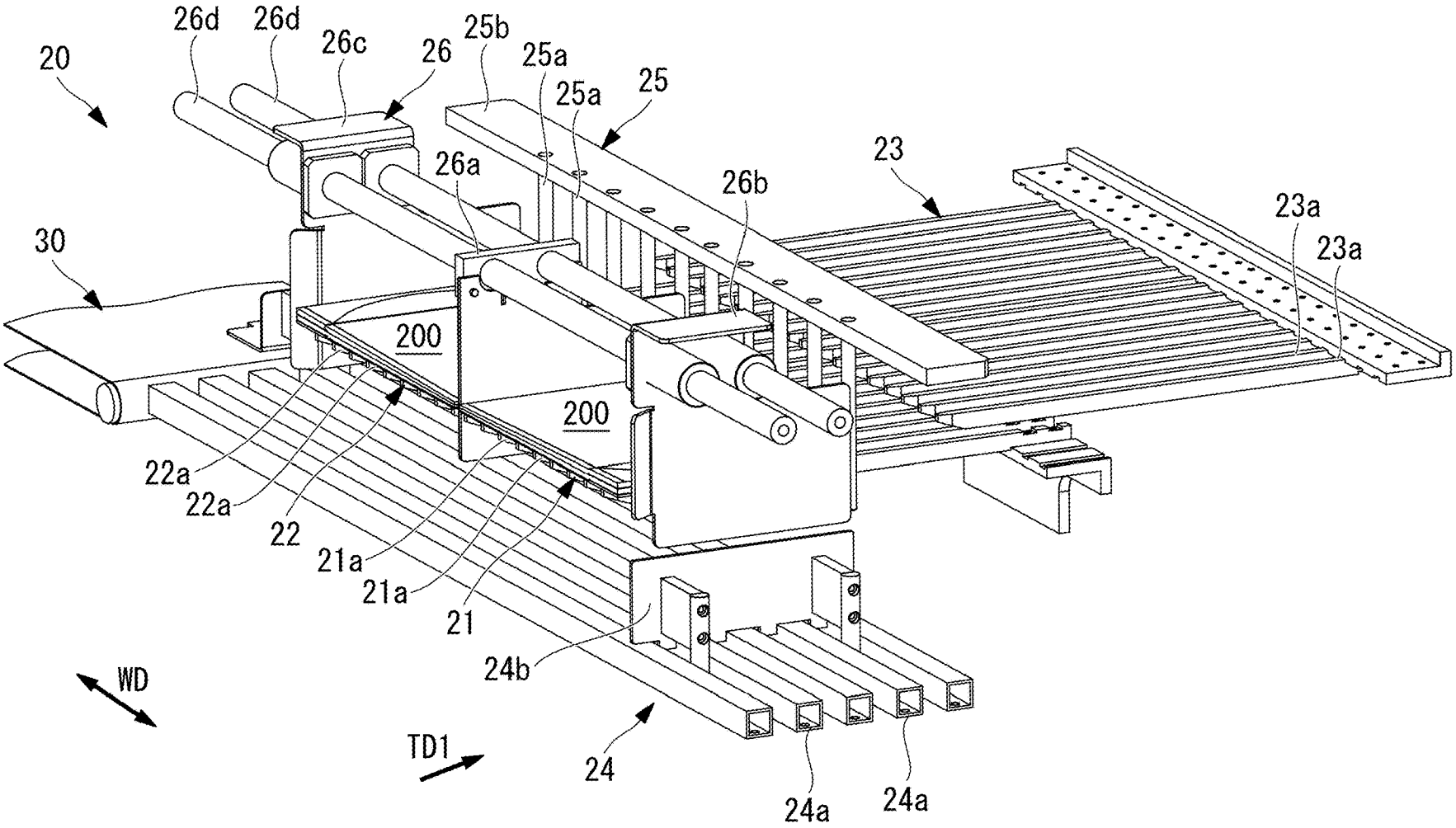
FIG. 18 is a perspective view of the loading unit illustrated in FIG. 1 and illustrates a state where bags were dropped from a third loading unit to the first loading unit and the second loading unit.
Figure 19:
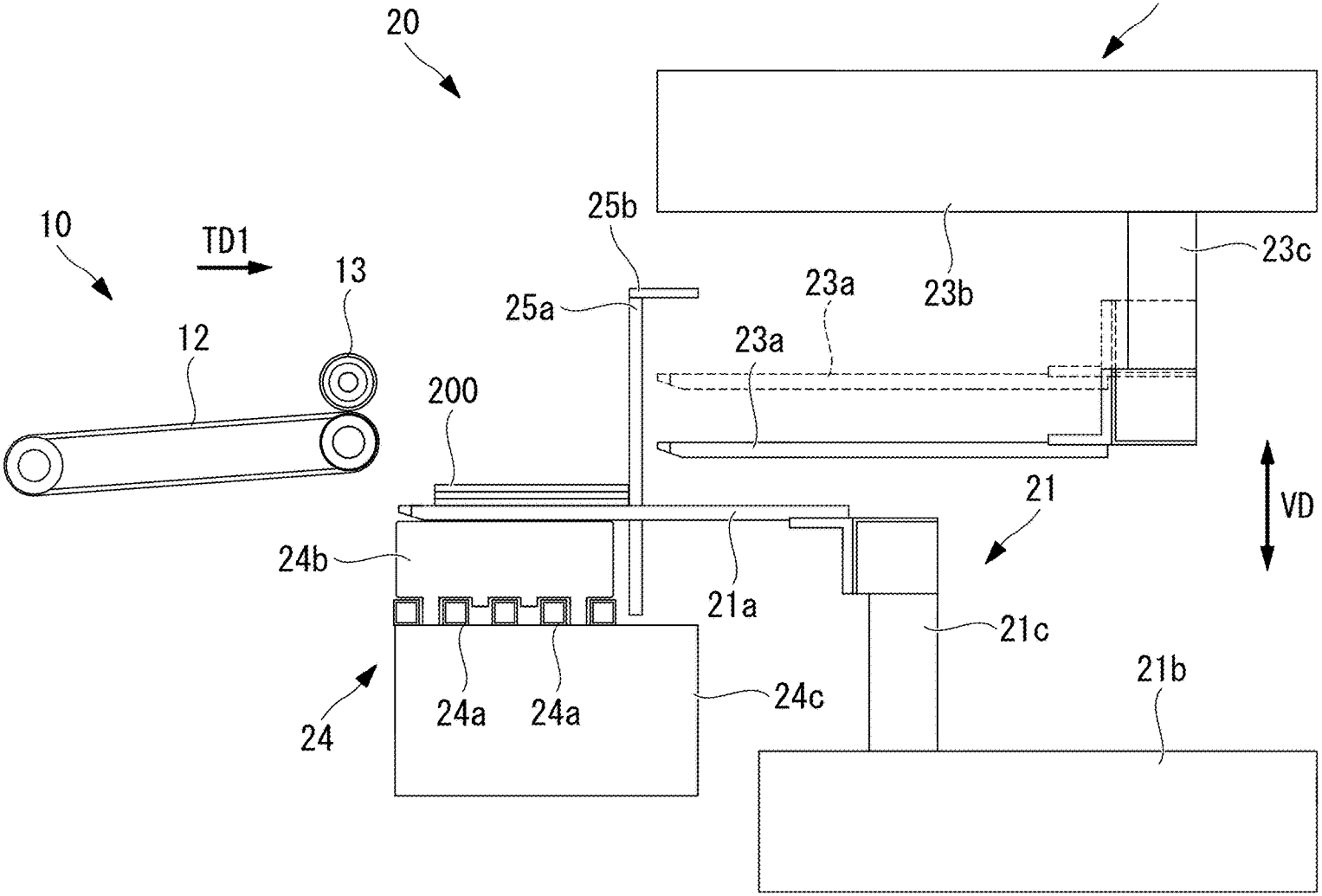
FIG. 19 is a side view of the loading unit illustrated in FIG. 18.

In response to the bags 200 loaded on the plurality of forks 23*a* being dropped onto the first loading unit 21 and the second loading unit 22, the state illustrated in FIG. 18 and FIG. 19 is resulted. FIG. 18 is a perspective view of the loading unit 20 illustrated in FIG. 1 and illustrates the state where the bags 200 were dropped from the third loading unit 23 to the first loading unit 21 and the second loading unit 22. FIG. 19 is a side view of the loading unit 20 illustrated in FIG. 18.

After dropping the bags 200 loaded on the plurality of forks 23*a* onto the first loading unit 21 and the second loading unit 22, the control unit 40 uses the vertical motion mechanism 23*c* to move the plurality of forks 23*a* to the position illustrated by the dotted line in FIG. 19. The position illustrated by the dotted line in FIG. 19 is a position in the vertical direction VD above the position to which the bags 200 transported by the transport unit 10 are guided. Further, the control unit 40 controls the horizontal motion mechanism 23*b* to move the plurality of forks 23*a* back to the position illustrated in FIG. 6.

As illustrated in FIG. 19, once the plurality of forks 23*a* are pulled out from the first guide 25, this results in a state where the bags 200 transported from the transport unit 10 to the loading unit 20 are loaded on the first loading unit 21 and the second loading unit 22. The control unit 40 controls the loading unit 20 to drop the bags 200 of the third loading unit 23 onto the first loading unit 21 and the second loading unit 22 in step S107 and thereby switches the second loading mode to the first loading mode. The control unit 40 then transfers control signals to the vertical motion mechanism 21*c* and the vertical motion mechanism 22*c* so that the positions in the vertical direction VD of the first loading unit 21 and the second loading unit 22 are at the positions illustrated in FIG. 6.

In step S108, the control unit 40 determines whether or not to end the process of the present flowchart and ends the process of the present flowchart if the determination is YES or returns the process to step S101 if the determination is NO.

In the above description, the example in which the transport unit 10 transports the bags 200 supplied in two lines of the first line Co1 and the second line Co2 in the transport direction TD1 from the bag-making machine 300 has been described. However, the transport unit 10 of the present embodiment can also transport the bags 200 supplied in any one of the first line Co1 and the second line Co2 in the transport direction TD1 from the bag-making machine 300. In such a case, the loading unit 20 loads a plurality of bags 200 supplied in the single line on the first loading unit 21 or the second loading unit 22, drops the bags 200 onto the discharge unit 24, and discharges the bags 200 to the bundling unit 30. The bag loading apparatus 100 of the present embodiment can switch the mode between a mode to process the bags 200 supplied in two lines of the first line Co1 and the second line Co2 and a mode to process the bags 200 supplied in any one line of the first line Co1 and the second line Co2.

The effects and advantages achieved by the bag loading apparatus 100 of the present embodiment described above will be described.

According to the bag loading apparatus 100 of the present embodiment, the bags 200 of the first line Co1 transported by the transport unit 10 and loaded on the first loading unit 21 are dropped from the first loading unit 21 onto the discharge unit 24. The plurality of bags 200 of the first line Co1 dropped onto the discharge unit 24 are moved to the area under a plurality of bags 200 of the second line Co2 loaded on the second loading unit 22. The plurality of bags 200 of the second line Co2 loaded on the second loading unit 22 are dropped onto the plurality of bags 200 of the first line Co1, and the bundle 400 in which the plurality of bags 200 of the second line Co2 are stacked on the plurality of bags 200 of the first line Co1 is formed.

According to the bag loading apparatus 100 of the present embodiment, the thickness T2 on one side in the width direction WD of the bags 200 of the first line Co1 is larger than the thickness T1 of the other side in the width direction WD thereof, and the thickness T1 on one side in the width direction WD of the bags of the second line Co2 is smaller than the thickness T2 of the other side in the width direction WD thereof. Thus, the overall thickness of the plurality of bags 200 of the first line Co1 is larger on one side than on the other side in the width direction WD, and the overall thickness of the plurality of bags 200 of the second line Co2 is smaller on one side than on the other side in the width direction WD. Further, in the bundle 400 in which all the plurality of bags 200 of the second line Co2 are stacked on all the plurality of bags 200 of the first line Co1, the difference between the thickness on one side in the width direction WD and the thickness on the other side in the width direction WD is made even.

As described above, according to the bag loading apparatus 100 of the present embodiment, the bundle 400 of a plurality of bags 200 stacked on each other can have an even height over the entire area. Further, since operation to change the orientation of the bags 200 one by one is not required, the time required to stack the plurality of bags 200 to form the bundle 400 can be shortened.

According to the bag loading apparatus 100 of the present embodiment, in the second loading mode to load the bags 200 transported by the transport unit 10 on the third loading unit 23, a plurality of bags 200 of the first line Co1 are dropped from the first loading unit 21 onto the discharge unit 24, and a plurality of bags 200 of the second line Co2 are dropped from the second loading unit 22 onto the discharge unit 24. Thus, when performing the operation to drop the bags 200 from the first loading unit 21 and the second loading unit 22 onto the discharge unit 24, it is possible to load the bags transported from the transport unit 10 on the third loading unit 23 without suspending the transport operation on the bags 200 performed by the transport unit 10.

Further, according to the bag loading apparatus 100 of the present embodiment, in the second loading mode, a plurality of bags 200 loaded on the third loading unit 23 are dropped onto the first loading unit 21 and the second loading unit 22. Thus, the bags transported from the transport unit 10 to the third loading unit 23 can be guided to the first loading unit 21 and the second loading unit 22 during the operation to drop the bags 200 from the first loading unit 21 and the second loading unit 22 onto the discharge unit 24.

Further, according to the bag loading apparatus 100 of the present embodiment, a bundle in which the difference between the thickness on one side in the width direction WD and the thickness on the other side in the width direction WD is made even in the discharge unit 24 can be discharged from the discharge unit 24 to the bundling unit 30 and bound with the banding band 410.

[Reference Signs List]

| | |
|---|---|
| 10 | transport unit (transport device) |
| 20 | loading unit |
| 21 | first loading unit |
| 2la | fork |
| 21b | horizontal motion mechanism |
| 21c | vertical motion mechanism |
| 22 | second loading unit |
| 22a | fork |
| 22b | horizontal motion mechanism |
| 22c | vertical motion mechanism |
| 23 | third loading unit |
| 23a | fork |
| 23b | horizontal motion mechanism |
| 23c | vertical motion mechanism |
| 24 | discharge unit |
| 24a | cylindrical member |
| 24b | discharge pusher |
| 24c | slide mechanism |
| 25 | first guide |
| 26 | second guide |
| 30 | bundling unit (bundling device) |
| 31 | transport conveyer |
| 32 | bundling mechanism |
| 40 | control unit (control device) |
| 100 | bag loading apparatus |
| 200 | bag |
| 210 | opening |
| 220 | bottom part |
| 230, 240 | seal part |
| 300 | bag-making machine |
| 400 | bundle |
| 410 | banding band |
| 500 | accumulation unit |
| Co1 | first line |
| Co2 | second line |
| T1, T2 | thickness |

-continued

[Reference Signs List]

| | |
|---|---|
| TD1, TD2 | transport direction |
| VD | vertical direction |
| WD | width direction |

The invention claimed is:

1. A bag loading apparatus configured to load bags, the bag loading apparatus comprising:

a transport unit configured to transport the bags in a transport direction in a plurality of lines;

a first loading unit configured to load the bags of a first line transported by the transport unit;

a second loading unit configured to load the bags of a second line transported by the transport unit;

a discharge unit arranged below the first loading unit and the second loading unit; and a control unit configured to control the bag loading apparatus, wherein each bag includes an opening with an opening thickness and a bottom part with a bottom part thickness, wherein the bottom part thickness is larger than the opening thickness, wherein the control unit controls the transport unit such that the orientation of the opening and bottom part of the bags of the first line is different from the orientation of the opening and bottom part of the bags of the second line in a width direction, controls the first loading unit to drop the plurality of bags of the first line from the first loading unit onto the discharge unit, controls the discharge unit to move the plurality of bags of the first line dropped onto the discharge unit to an area under the plurality of bags of the second line loaded on the second loading unit, and controls the second loading unit to drop the plurality of bags of the second line from the second loading unit onto the plurality of bags of the first line the bag loading apparatus further comprising a third loading unit arranged above the first loading unit and the second loading unit and configured to load the bags in a plurality of lines transported by the transport unit, wherein the control unit performs control to switch a mode between a first loading mode and a second loading mode, the first loading mode being to load the bags transported by the transport unit on the first loading unit and the second loading unit, and the second loading mode being to load the bags transported by the transport unit on the third loading unit, and in the second loading mode, controls the first loading unit to drop the plurality of bags of the first line from the first loading unit onto the discharge unit, controls the second loading unit to drop the plurality of bags of the second line from the second loading unit onto the discharge unit, and controls the third loading unit to drop the plurality of bags loaded on the third loading unit onto the first loading unit and the second loading unit.

2. A bag loading apparatus configured to load bags, the bag loading apparatus comprising:

a transport unit configured to transport the bags in a transport direction in a plurality of lines;

a first loading unit configured to load the bags of a first line transported by the transport unit;

a second loading unit configured to load the bags of a second line transported by the transport unit;

a discharge unit arranged below the first loading unit and the second loading unit; and a control unit configured to control the bag loading apparatus, wherein each bag includes an opening with an opening thickness and a bottom part with a bottom part thickness, wherein the bottom part thickness is larger than the opening thickness, wherein the control unit controls the transport unit such that the orientation of the opening and bottom part of the bags of the first line is different from the orientation of the opening and bottom part of the bags of the second line in a width direction, controls the first loading unit to drop the plurality of bags of the first line from the first loading unit onto the discharge unit, controls the discharge unit to move the plurality of bags of the first line dropped onto the discharge unit to an area under the plurality of bags of the second line loaded on the second loading unit, and controls the second loading unit to drop the plurality of bags of the second line from the second loading unit onto the plurality of bags of the first line the bag loading apparatus further comprising a bundling unit configured to bind a bundle with a banding band, the plurality of bags of the second line being stacked on the plurality of bags of the first line in the bundle, wherein the control unit controls the discharge unit to discharge the bundle to the bundling unit.

3. A control method of a bag loading apparatus configured to load bags, wherein the bag loading apparatus comprises a transport unit configured to transport the bags in a transport direction in a plurality of lines, a first loading unit configured to load the bags of a first line transported by the transport unit, a second loading unit configured to load the bags of a second line transported by the transport unit, and a discharge unit arranged below the first loading unit and the second loading unit, wherein each bag includes an opening with an opening thickness and a bottom part with a bottom part thickness, wherein the bottom part thickness is larger than the opening thickness, the control method comprising:

a transport step of controlling the transport unit to load the plurality of bags of the first line on the first loading unit and load the plurality of bags of the second line on the second loading unit, wherein the orientation of the opening and bottom part of the bags of the first line is different from the orientation of the opening and bottom part of the bags of the second line in a width direction;

a first drop step of controlling the first loading unit to drop the plurality of bags of the first line from the first loading unit onto the discharge unit;

a motion step of controlling the discharge unit to move the plurality of bags of the first line dropped onto the discharge unit to an area under the plurality of bags of the second line loaded on the second loading unit; and a second drop step of controlling the second loading unit to drop the plurality of bags of the second line from the second loading unit onto the plurality of bags of the first line, wherein the bag loading apparatus further comprises a third loading unit arranged above the first loading unit and the second loading unit and configured to load the bags in a plurality of lines transported by the transport unit, the control method further comprising:

a switching step of switching a first loading mode to a second loading mode, the first loading mode being to load the bags transported by the transport unit on the first loading unit and the second loading unit, and the second loading mode being to load the bags transported by the transport unit on the third loading unit; and a third drop step of controlling the third loading unit to drop the plurality of bags loaded on the third loading unit onto the first loading unit and the second loading unit, wherein the first drop step, the second drop step, and the third drop step are performed in the second loading mode.

4. A control method of a bag loading apparatus configured to load bags, wherein the bag loading apparatus comprises a transport unit configured to transport the bags in a transport direction in a plurality of lines, a first loading unit configured to load the bags of a first line transported by the transport unit, a second loading unit configured to load the bags of a second line transported by the transport unit, and a discharge unit arranged below the first loading unit and the second loading unit, wherein each bag includes an opening with an opening thickness and a bottom part with a bottom part thickness, wherein the bottom part thickness is larger than the opening thickness, the control method comprising:

a transport step of controlling the transport unit to load the plurality of bags of the first line on the first loading unit and load the plurality of bags of the second line on the second loading unit, wherein the orientation of the opening and bottom part of the bags of the first line is different from the orientation of the opening and bottom part of the bags of the second line in a width direction;

a first drop step of controlling the first loading unit to drop the plurality of bags of the first line from the first loading unit onto the discharge unit;

a motion step of controlling the discharge unit to move the plurality of bags of the first line dropped onto the discharge unit to an area under the plurality of bags of the second line loaded on the second loading unit; and a second drop step of controlling the second loading unit to drop the plurality of bags of the second line from the second loading unit onto the plurality of bags of the first line, wherein the bag loading apparatus comprises a bundling unit configured to bind a bundle with a banding band, the plurality of bags of the second line being stacked on the plurality of bags of the first line in the bundle, the control method further comprising a discharge step of controlling the discharge unit to discharge the bundle to the bundling unit.

* * * * *